US010204727B2

(12) United States Patent
Fullerton et al.

(10) Patent No.: US 10,204,727 B2
(45) Date of Patent: Feb. 12, 2019

(54) SYSTEMS AND METHODS FOR PRODUCING MAGNETIC STRUCTURES

(71) Applicant: Correlated Magnetics Research, LLC, Huntsville, AL (US)

(72) Inventors: Larry W. Fullerton, New Hope, AL (US); Mark D. Roberts, Huntsville, AL (US); Jason N. Morgan, Brownsboro, AL (US)

(73) Assignee: Correlated Magnetics Research, LLC, Huntsville, AL (US)

( * ) Notice: Subject to any disclaimer, the term of this patent is extended or adjusted under 35 U.S.C. 154(b) by 223 days.

(21) Appl. No.: 15/082,605

(22) Filed: Mar. 28, 2016

(65) Prior Publication Data

US 2016/0211066 A1 Jul. 21, 2016

Related U.S. Application Data

(63) Continuation-in-part of application No. 14/198,400, filed on Mar. 5, 2014, now abandoned, which is a continuation-in-part of application No. 13/659,444, filed on Oct. 24, 2012, now abandoned, and a continuation-in-part of application No. 13/959,201, filed on Aug. 5, 2013, now Pat. No. 9,257,219, and a continuation-in-part of application No. 14/052,891, (Continued)

(51) Int. Cl.

| | |
|---|---|
| ***H01F 13/00*** | (2006.01) |
| ***H01F 41/02*** | (2006.01) |
| ***H01F 7/02*** | (2006.01) |

(52) U.S. Cl.

CPC ..... *H01F 13/003* (2013.01); *H01F 7/021* (2013.01); *H01F 41/02* (2013.01)

(58) Field of Classification Search

CPC ..... H01F 13/003; H01F 41/02; H01F 7/021

See application file for complete search history.

(56) References Cited

U.S. PATENT DOCUMENTS 4,614,929 A * 9/1986 Tsukuda ..... H01F 13/003 335/284

2004/0155748 A1* 8/2004 Steingroever ..... H01F 30/06 336/200

* cited by examiner

*Primary Examiner* — Scott Bauer

(74) *Attorney, Agent, or Firm* — Vector IP Law Group LLC; Robert S. Babayi

(57) ABSTRACT

A system for magnetizing magnetic sources into a rare earth permanent magnet material includes a first inductor coil, a second inductor coil, and at least one magnetizing circuit for supplying a first current having a first direction for a first duration to said first inductor coil to produce a first magnetic field and a second current having a second direction for a second duration to said second inductor coil to produce a second magnetic field. The first inductor coil comprises a first plurality of layers of a flat conductor about a first aperture positioned on a first side of the rare earth permanent magnet material at a first location where a magnetic source is to be magnetized into the rare earth permanent magnet material from the first side of the rare earth permanent magnet material. The second inductor coil comprising a second plurality of layers of a flat conductor coiled about a second aperture positioned on a second side of the rare earth permanent magnet material at a second location where a magnetic source is to be magnetized into the rare earth permanent magnet material from the second side of said rare earth permanent magnet material, where the second side is opposite the first side.

20 Claims, 26 Drawing Sheets

Related U.S. Application Data filed on Oct. 14, 2013, now Pat. No. 9,275,783, and a continuation-in-part of application No. 14/045,756, filed on Oct. 3, 2013, now Pat. No. 8,810,348, which is a continuation-in-part of application No. 13/240,335, filed on Sep. 22, 2011, now Pat. No. 8,648,681, which is a continuation-in-part of application No. 12/476,952, filed on Jun. 2, 2009, now Pat. No. 8,179,219, and a continuation-in-part of application No. 12/895,589, filed on Sep. 30, 2010, now Pat. No. 8,760,250, which is a continuation-in-part of application No. 12/885,450, filed on Sep. 18, 2010, now Pat. No. 7,982,568, and a continuation-in-part of application No. 12/476,952, said application No. 14/045,756 is a continuation-in-part of application No. 13/246,584, filed on Sep. 27, 2011, now Pat. No. 8,760,251, application No. 15/082,605, which is a continuation-in-part of application No. 14/532,730, filed on Nov. 4, 2014, now abandoned, which is a continuation-in-part of application No. 13/659,444, application No. 15/082,605, which is a continuation-in-part of application No. 14/462,341, filed on Aug. 18, 2014, now Pat. No. 9,404,776, which is a continuation-in-part of application No. 14/045,756.

(60) Provisional application No. 61/851,613, filed on Mar. 11, 2013, provisional application No. 61/717,444, filed on Oct. 25, 2011, provisional application No. 61/742,260, filed on Aug. 6, 2012, provisional application No. 61/795,352, filed on Oct. 15, 2012, provisional application No. 61/744,864, filed on Oct. 4, 2012, provisional application No. 61/403,814, filed on Sep. 22, 2010, provisional application No. 61/462,715, filed on Feb. 7, 2011, provisional application No. 61/277,214, filed on Sep. 22, 2009, provisional application No. 61/277,900, filed on Sep. 30, 2009, provisional application No. 61/278,767, filed on Oct. 9, 2009, provisional application No. 61/279,094, filed on Oct. 16, 2009, provisional application No. 61/281,160, filed on Nov. 13, 2009, provisional application No. 61/283,780, filed on Dec. 9, 2009, provisional application No. 61/284,385, filed on Dec. 17, 2009, provisional application No. 61/342,988, filed on Apr. 22, 2010, provisional application No. 62/139,186, filed on Mar. 27, 2015.

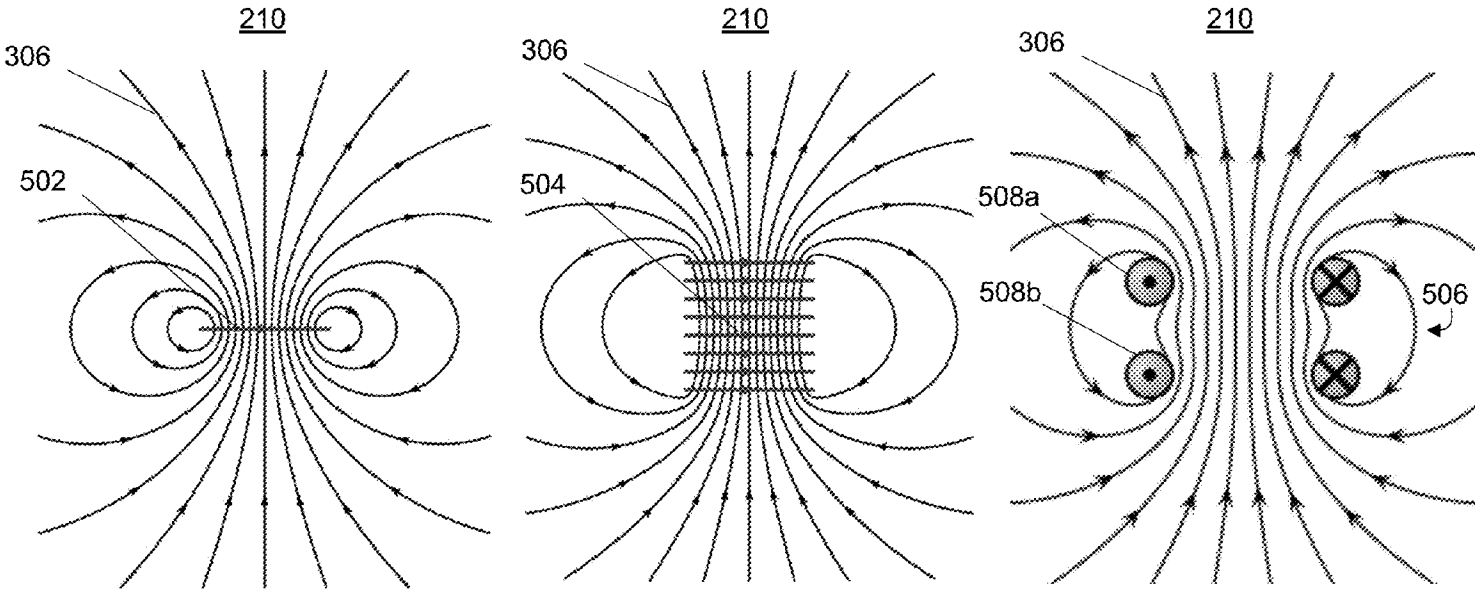
FIG. 5A
FIG. 5B
FIG. 5C
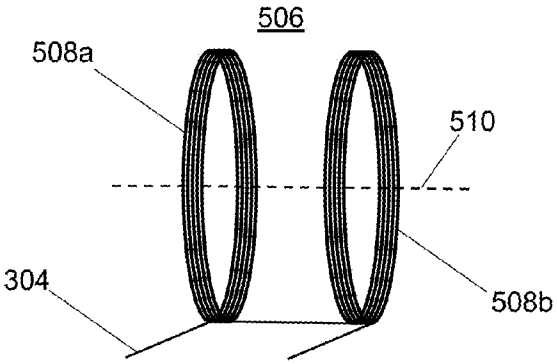
FIG. 5D

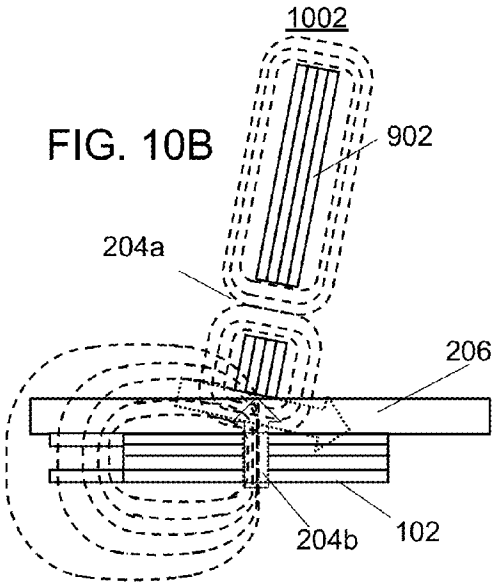
FIG. 10A
FIG. 10B
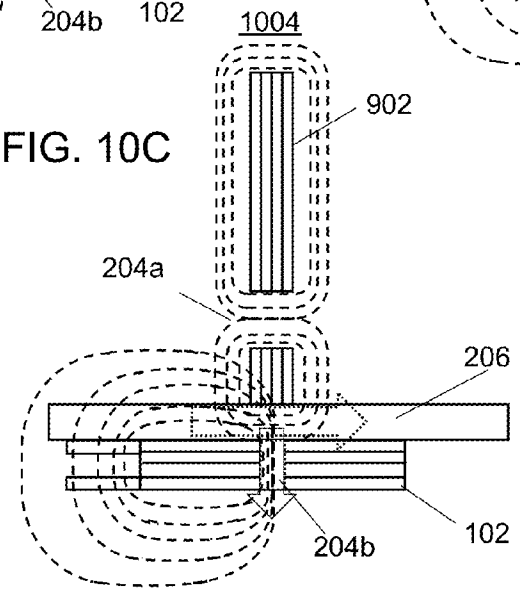
FIG. 10C
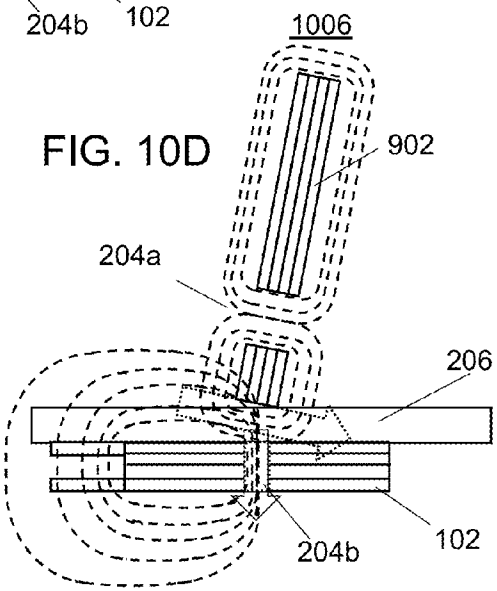
FIG. 10D (Side View)

(Side View)

(Side View)

(Top View)

(Bottom View)

SYSTEMS AND METHODS FOR PRODUCING MAGNETIC STRUCTURES

RELATED APPLICATIONS

This non-provisional patent application is a continuation-in-part of non-provisional patent application Ser. No. 14/198,400, filed Mar. 5, 2014, which is a continuation in part of non-provisional application Ser. No. 13/659,444, filed Oct. 24, 2012, titled "A System and Method for Producing Magnetic Structures" by Fullerton et al.; Ser. No. 14/198,400 claims the benefit under 35 USC 119(e) of provisional application 61/851,613, titled "A System and Method for Producing Magnetic Structures", filed Mar. 11, 2013, by Fullerton et al.; Ser. No. 13/659,444 claims the benefit under 35 USC 119(e) of provisional application 61/717,444, titled "A System and Method for Producing Magnetic Structures", filed Oct. 25, 2011 by Fullerton et al.; Ser. No. 14/198,400 is also a continuation in part of non-provisional application Ser. No. 13/959,201, filed Aug. 5, 2013, titled "System and Method for Magnetization" by Fullerton et al, which claims the benefit under 35 USC 119(e) of provisional application 61/742,260, titled "System and Method for Focusing Magnetic Fields", filed Aug. 6, 2012, by Fullerton et al.; Ser. No. 14/198,400 is also a continuation in part of non-provisional application Ser. No. 14/052,891, filed Oct. 14, 2013, titled "System and Method for Demagnetization of a Magnetic Structure Region" by Fullerton et al, which claims the benefit under 35 USC 119(e) of provisional application 61/795,352, titled "System and Method for Demagnetization of a Magnetic Structure Region", filed Oct. 15, 2012, by Fullerton et al.; Ser. No. 14/198,400 is also a continuation in part of U.S. non-provisional Pat. No. 8,810,348, issued Aug. 19, 2014, titled "System And Method For Tailoring Polarity Transitions of Magnetic Structures" by Fullerton et al. which claims the benefit under 35 USC 119(e) of U.S. Provisional Patent Application No. 61/744,864, titled "System And Method For Tailoring Polarity Transitions of Magnetic Structures", filed Oct. 4, 2012, by Fullerton et al; U.S. Pat. No. 8,810,348 is a continuation-in-part of U.S. non-provisional Pat. No. 8,648,681, issued Feb. 11, 2014, titled "Magnetic Structure Production", which claims the benefit of U.S. provisional patent application No. 61/403,814, filed Sep. 22, 2010, titled "System and Method for Producing Magnetic Structures" and U.S. provisional patent application No. 61/462,715, filed Feb. 7, 2011, titled "System and Method for Producing Magnetic Structures"; U.S. Pat. No. 8,648,681 is a continuation-in-part of U.S. non-provisional Pat. No. 1 8,179,219, issued May 15, 2012, titled "Field Emission System And Method"; U.S. Pat. No. 8,648,681 is also a continuation-in-part of U.S. Pat. No. 8,760,250, issued Jun. 24, 2012, titled "A System And Method For Energy Generation", which claims the benefit of provisional patent application Nos. 61/277,214, filed Sep. 22, 2009, 61/277,900 filed Sep. 30, 2009, 61/278,767, filed Oct. 9, 2009, 61/279,094, filed Oct. 16, 2009, 61/281,160, filed Nov. 13, 2009, 61/283,780, filed Dec. 9, 2009, 61/284,385, filed Dec. 17, 2009, and 61/342,988, filed Apr. 22, 2010; U.S. Pat. No. 8,760,250 is a continuation-in-part of non-provisional U.S. Pat. No. 7,982,568, issued Jul. 19, 2011, and U.S. Pat. No. 8,179,219, issued May 15, 2012; U.S. Pat. No. 8,810,348 is also a continuation-in-part of U.S. non-provisional Pat. No. 8,760,251, issued Jun. 24, 2014, titled "System and Method for Producing Stacked Field Emission Structures".

This non-provisional patent application is a continuation-in-part of non-provisional patent application Ser. No. 14/532,730, filed Nov. 4, 2014, which is a continuation in part of non-provisional application Ser. No. 13/659,444, filed Oct. 24, 2012, titled "A System and Method for Producing Magnetic Structures" by Fullerton et al.

This non-provisional patent application is a continuation-in-part of non-provisional patent application Ser. No. 14/462,341, filed Aug. 8, 2014, which is a continuation in part of U.S. Pat. No. 8,810,348, titled "A System and Method for Tailoring Transition Regions of Magnetic Structures" by Fullerton et al.

This non-provisional patent application claims the benefit under 35 USC 119(e) of provisional application 62/139,186, titled "Systems and Methods for Producing Magnetic Structures", filed Mar. 27, 2015, by Fullerton et al.

The contents of the provisional patent applications, the contents of the non-provisional patent applications, and the contents of the issued patents that are identified above are hereby incorporated by reference in their entirety herein.

SUMMARY OF THE INVENTION

In accordance with a first aspect of the invention, a system for magnetizing magnetic sources into a rare earth permanent magnet material includes a first inductor coil comprising a first plurality of layers of a flat conductor about a first aperture positioned on a first side of the rare earth permanent magnet material at a first location where a magnetic source is to be magnetized into the rare earth permanent magnet material from the first side of the rare earth permanent magnet material; a second inductor coil comprising a second plurality of layers of a flat conductor coiled about a second aperture positioned on a second side of the rare earth permanent magnet material at a second location where a magnetic source is to be magnetized into the rare earth permanent magnet material from the second side of the rare earth permanent magnet material, the second side being opposite the first side; and at least one magnetizing circuit for supplying a first current having a first direction for a first duration to the first inductor coil to produce a first magnetic field and a second current having a second direction for a second duration to the second inductor coil to produce a second magnetic field.

The first inductor coil and the second inductor coil can be configured to produce magnetic fields having substantially the same field strengths when substantially the same amount of current is supplied to each of the two print heads.

The first inductor coil and the second inductor coil can be connected in series to a magnetizing circuit via a supply line.

The first aperture and the second aperture can be substantially aligned with each other.

The first inductor coil and the second inductor coil can be driven by independent magnetizing circuits via separate supply lines.

The first inductor coil and the second inductor coil can be configured to have substantially matched impedance.

The first inductor coil and the second inductor coil can be supplied substantially the same amounts of current having the same directions for the same durations.

The first inductor coil and the second inductor coil can be supplied at least one of a different amount of current, currents for different durations, or currents having different directions.

The coil diameter of the first inductor coil can be substantially the same as the coil diameter of the second inductor coil.

The diameter of the first aperture can be substantially the same as the diameter of the second aperture.

The first inductor coil and the second inductor coil can have substantially the same aperture diameter-to-coil diameter ratio.

The conductor layers of the first inductor coil can have substantially the same thickness as the conductor layers of the second inductor coil.

The first inductor coil and the second inductor coil can have substantially the same number of coil layers.

The first inductor coil and the second inductor coil can have vertical apertures.

At least one of the first inductor coil or the second inductor coil can have one of an angled aperture or a conical aperture.

The first magnetic field and the second magnetic field can at least partially cancel.

The first magnetic field and the second magnetic field can produce a magnetic source that extends from the first side of the rare earth permanent magnet material to the second side of the rare earth permanent magnet material.

The magnetic source can have a substantially cylindrical volume in the rare earth permanent magnet material.

In accordance with another aspect of the invention, a method for magnetizing magnetic sources into a rare earth permanent magnet material includes providing a first inductor coil comprising a first plurality of layers of a flat conductor about a first aperture;

positioning the first aperture on a first side of the rare earth permanent magnet material at a first location where a magnetic source is to be magnetized into the rare earth permanent magnet material from the first side of the rare earth permanent magnet material; providing a second inductor coil comprising a second plurality of layers of a flat conductor coiled about a second aperture; positioning the second aperture on a second side of the rare earth permanent magnet material at a second location where a magnetic source is to be magnetized into the rare earth permanent magnet material from the second side of the rare earth permanent magnet material, the second side being opposite the first side; and supplying using at least one magnetizing circuit a first current having a first direction for a first duration to the first inductor coil to produce a first magnetic field and a second current having a second direction for a second duration to the second inductor coil to produce a second magnetic field.

The first magnetic field and the second magnetic field can produce a magnetic source that extends from the first side of the rare earth permanent magnet material to the second side of the rare earth permanent magnet material.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

FIG. 5A depicts exemplary magnetic flux lines of an exemplary magnetic field produced by a wire loop;

FIG. 5B depicts exemplary magnetic flux lines of an exemplary magnetic field produced by an exemplary eight turn solenoid coil;

FIG. 5C depicts exemplary magnetic flux lines of an exemplary magnetic field produced by an exemplary single axis Helmholtz coil system comprising two identical circular N-turn solenoid coils configured along a common axis;

FIG. 5D depicts an oblique projection of an exemplary single axis Helmholtz coil system comprising two identical four-turn solenoid coils configured along a common axis;

FIG. 10A depicts an exemplary dual-sided maxel printing system comprising a first print head configured to produce a maxel using the field at an outer coil perimeter and a second print head configured to producing a maxel using the field near the aperture of the print head, where the first print head is vertical relative to the surface of the material being magnetized;

FIG. 10B depicts an exemplary dual-sided maxel printing system comprising a first print head configured to produce a maxel using the field at an outer coil perimeter and a second print head configured to producing a maxel using the field near the aperture of the print head, where the first print head is angled relative to the surface of the material being magnetized;

FIG. 10C depicts an exemplary dual-sided maxel printing system like that of FIG. 10A except the direction of the magnetic field of the second print head is reversed;

FIG. 10D depicts an exemplary dual-sided maxel printing system like that of FIG. 10B except the direction of the magnetic field of the second print head is reversed;

DETAILED DESCRIPTION OF THE INVENTION

Figure 1A:
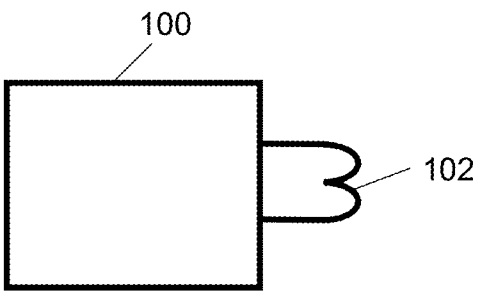
FIG. 1A depicts an exemplary monopolar magnetizing circuit driving one print head.

The present invention will now be described more fully in detail with reference to the accompanying drawings, in which the preferred embodiments of the invention are shown. This invention should not, however, be construed as limited to the embodiments set forth herein; rather, they are provided so that this disclosure will be thorough and complete and will fully convey the scope of the invention to those skilled in the art.

Certain described embodiments may relate, by way of example but not limitation, to systems and/or apparatuses for producing magnetic structures, methods for producing magnetic structures, magnetic structures produced via magnetic printing, combinations thereof, and so forth. Example realizations for such embodiments may be facilitated, at least in part, by the use of an emerging, revolutionary technology that may be termed correlated magnetics. This revolutionary technology referred to herein as correlated magnetics was first fully described and enabled in the co-assigned U.S. Pat. No. 7,800,471 issued on Sep. 21, 2010, and entitled "A Field Emission System and Method". The contents of this document are hereby incorporated herein by reference. A second generation of a correlated magnetic technology is described and enabled in the co-assigned U.S. Pat. No. 7,868,721 issued on Jan. 11, 2011, and entitled "A Field Emission System and Method". The contents of this document are hereby incorporated herein by reference. A third generation of a correlated magnetic technology is described and enabled in the co-assigned U.S. Pat. No. 8,179,219 issued on May 15, 2012, and entitled "A Field Emission System and Method". The contents of this document are hereby incorporated herein by reference. Another technology known as correlated inductance, which is related to correlated magnetics, has been described and enabled in the co-assigned U.S. Pat. No. 8,115,581 issued on Feb. 14, 2012, and entitled "A System and Method for Producing an Electric Pulse". The contents of this document are hereby incorporated by reference.

Material presented herein may relate to and/or be implemented in conjunction with multilevel correlated magnetic systems and methods for producing a multilevel correlated magnetic system such as described in U.S. Pat. No. 7,982,568 issued Jul. 19, 2011 which is all incorporated herein by reference in its entirety. Material presented herein may relate to and/or be implemented in conjunction with energy generation systems and methods such as described in U.S. patent application Ser. No. 13/184,543 filed Jul. 17, 2011, which is all incorporated herein by reference in its entirety. Such systems and methods described in U.S. Pat. No. 7,681,256 issued Mar. 23, 2010, U.S. Pat. No. 7,750,781 issued Jul. 6, 2010, U.S. Pat. No. 7,755,462 issued Jul. 13, 2010, U.S. Pat. No. 7,812,698 issued Oct. 12, 2010, U.S. Pat. Nos. 7,817,002, 7,817,003, 7,817,004, 7,817,005, and 7,817,006 issued Oct. 19, 2010, U.S. Pat. No. 7,821,367 issued Oct. 26, 2010, U.S. Pat. Nos. 7,823,300 and 7,824,083 issued Nov. 2, 2011, U.S. Pat. No. 7,834,729 issued Nov. 16, 2011, U.S. Pat. No. 7,839,247 issued Nov. 23, 2010, U.S. Pat. Nos. 7,843,295, 7,843,296, and 7,843,297 issued Nov. 30, 2010, U.S. Pat. No. 7,893,803 issued Feb. 22, 2011, U.S. Pat. Nos. 7,956,711 and 7,956,712 issued Jun. 7, 2011, U.S. Pat. Nos. 7,958,575, 7,961,068 and 7,961,069 issued Jun. 14, 2011, U.S. Pat. No. 7,963,818 issued Jun. 21, 2011, and U.S. Pat. Nos. 8,015,752 and 8,016,330 issued Sep. 13, 2011 are all incorporated by reference herein in their entirety.

The number of dimensions to which coding can be applied to design correlated magnetic structures is very high giving the correlated magnetic structure designer many degrees of freedom. For example, the designer can use coding to vary magnetic source size, shape, polarity, field strength, and location relative to other sources in one, two, or three-dimensional space, and, if using electromagnets or electro-permanent magnets can even change many of the source characteristics in time using a control system. Various techniques can also be applied to achieve multi-level magnetism control. In other words, the interaction between two structures may vary depending on their separation distance. The possible combinations are essentially unlimited.

The present invention pertains to producing magnetic structures by magnetically printing magnetic sources or magnetic pixels (or maxels) into magnetizable material, which can be described as magnetizing spots or spot magnetization. It is enabled by a magnetizer that functions as a magnetic printer that is able to move a magnetizable material relative to the location of a magnetic print head (and/or vice versa) so that magnetic pixels (or maxels) can be printed onto (and into) the magnetizable material in a prescribed pattern. When the magnetizer is printing maxels, the print head is adjacent to the magnetizable material, where the maxel is printed (or magnetized) by the magnetic field emerging from the aperture of the print head instead of the magnetic field inside the aperture (i.e., hole) of the print head. Typically, the magnetizable material being spot magnetized is much greater in size than the size of the aperture of the print head and therefore the magnetizable material is unable to fit inside the hole of the print head (i.e., the print head, an inductor coil, does not surround the material being magnetized as do the coils of most conventional magnetizers).

Characteristics of the print head can be established to produce a specific shape and size of maxel given a prescribed magnetization voltage and corresponding current for a given magnetizable material where characteristics of the magnetizable material can be taken into account as part of the printing process. The printer can be configured to magnetize in a direction perpendicular to a magnetization surface, but the printer can also be configured to magnetize in a direction non-perpendicular to a magnetization surface.

A magnetic printer having a print head, which is also referred to as an inductor coil, is described in U.S. patent application Ser. No. 12/476,952, filed Jun. 2, 2009, titled "A Field Emission System and Method", which is incorporated herein by reference. An alternative print head design is described in U.S. patent application Ser. No. 12/895,589, filed Sep. 3, 2010, titled "System and Method for Energy Generation", which is incorporated herein by reference. Another alternative print head design is described in relation to FIGS. 19A through 19P of U.S. Pat. No. 8,648,681, which was previously incorporated by reference.

In accordance with the invention, the magnetic field needs to be constrained to a small geometry at the point of contact with the material to be magnetized in order to produce a sharply defined maxel. Two principals were considered in the development of the magnetic circuit and magnetic printing head previously described. First, magnetizable materials may acquire their permanent magnetic polarization very rapidly, for example, in microseconds or even nanoseconds for many materials, and second, Lenz's Law causes conductors to exclude rapidly changing magnetic fields, i.e. such rapidly changing fields are not permitted to penetrate a good conductor by a depth called its "skin depth". Because of these two principals, the exemplary magnetizing circuit used with the exemplary print head described herein creates, for example, a large current pulse of 0.8 ms duration that has a bandwidth of about 1250 KHz, which yields a calculated skin depth of about 0.6 mm. As previously described, print heads can be designed to produce different sized maxels having different maxel diameters, for example, 4 mm, 3 mm, 2 mm, 1 mm, etc, where maxel diameter can also be greater than 4 mm or smaller than 1 mm. The exemplary print head previously described has a aperture in the center about 1 mm diameter and the thickness of the assembly is about 1 mm, so during the printing of a maxel a majority of the field lines are forced to traverse the aperture rather than permeate the copper plates (or layers) that make up the head. Therefore this combination of magnetization pulse characteristics and print head geometry creates a magnetic field having a very high flux density in and near the 1 mm aperture in the head and very low magnetic flux elsewhere resulting in a sharply defined maxel having approximately 1 mm diameter.

FIG. 1A depicts an exemplary monopolar magnetizing circuit 100 driving a print head 102 in accordance with the invention. Referring to FIG. 1A, the monopolar magnetizing circuit 100 provides a current to a print head 102 in either a first direction or a second direction opposite the first direction depending on how it is configured.

Figure 1B:
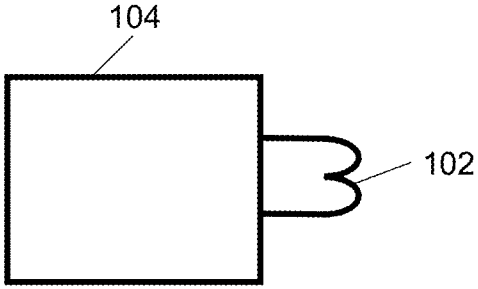
FIG. 1B depicts an exemplary bipolar magnetizing circuit driving one print head.

FIG. 1B depicts an exemplary bipolar magnetizing circuit 104 driving a print head 102 in accordance with the invention. The bipolar magnetizing circuit 104 is similar to the monopolar magnetizing circuit 100 except it provides a current to a print head 102 in a first direction when in a first mode and it provides a current to a print head 102 in a second direction opposite the first direction when in a second mode.

Figure 1C:
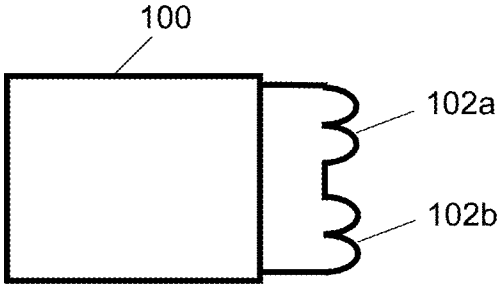
FIG. 1C depicts the exemplary monopolar magnetizing circuit of FIG. 1A driving two print heads.

FIG. 1C depicts the exemplary monopolary magnetizing circuit 100 of FIG. 1A driving two print heads 102*a* and 102*b*. Referring to FIG. 1C, the monopolar magnetizing circuit 100 provides a current to the two print heads 102*a* and 102*b* in either a first direction or a second direction opposite the first direction depending on how it is configured.

Figure 1D:
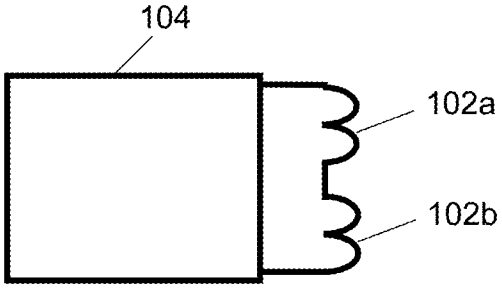
FIG. 1D depicts the exemplary bipolar magnetizing circuit of FIG. 1B driving two print heads.

FIG. 1D depicts the exemplary bipolar magnetizing circuit 104 of FIG. 1B driving two print heads 102*a* and 102*b* in accordance with the invention. The bipolar magnetizing circuit 104 is similar to the monopolar magnetizing circuit 100 except it provides a current to the two print heads 102*a* and 102*b* in a first direction when in a first mode and it provides a current to the print heads 102*a* and 102*b* in a second direction opposite the first direction when in a second mode.

One skilled in the art will recognize that the exemplary monopolar magnetizing circuit 100 can only produce maxels having a single polarity at the surface (i.e., North up) depending on how it is configured, unless it is reconfigured manually between magnetizations, whereas the exemplary bipolar magnetizing circuit 104 can produce maxels having either polarity at the surface (i.e., North up or South up). One skilled in the art will also recognize that two of the exemplary monopolar magnetizing circuits 100 could be employed, where one is configured to produce North up polarity maxels and the other is configured to produce South up polarity maxels.

Generally, various combinations of monopolar magnetizing circuits 100 and/or bipolar magnetizing circuits 104 can be used to independently drive two print heads as opposed to driving two print heads in series such as depicted in FIGS. 1C and 1D. For example, a first monopolar magnetizing circuit 100*a* could be used to drive a first print head 102*a* and a second monopolar magnetizing circuit 100*b* could be used to drive a second print head 102*b*. Similarly, a first bipolar magnetizing circuit 104*a* could be used to drive a first print head 102*a* and a second bipolar magnetizing circuit 104*b* could be used to drive a second print head 102*b*. Alternatively, a monopolar magnetizing circuit 100 could be used to drive a first print head 102*a* and a bipolar magnetizing circuit 104 could be used to drive a second print head 102*b*.

Additional disclosure pertaining to the monopolar magnetizing circuit 100 and the bipolar magnetizing circuit 104 of FIGS. 1A and 1B is also described in relation to FIGS. 70A-70B of U.S. Pat. No. 8,179,219, which was previously incorporated by reference.

Figure 2B:
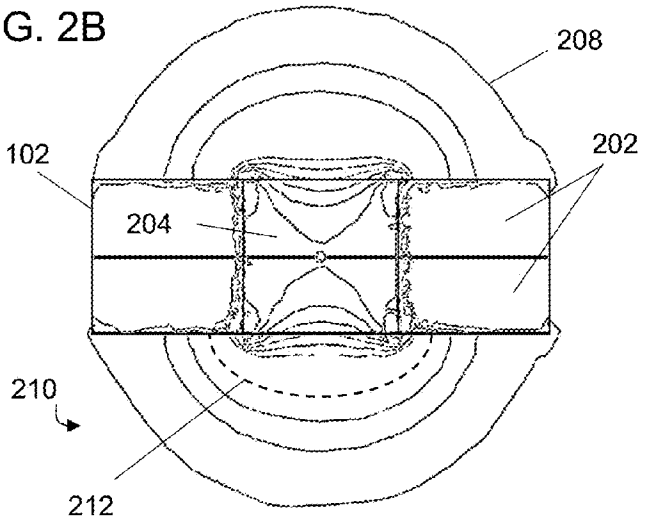
FIG. 2B depicts a cross sectional view of exemplary flux density contours corresponding to an exemplary magnetic field produced by the exemplary print head of FIG. 2A.
Figure 2A:
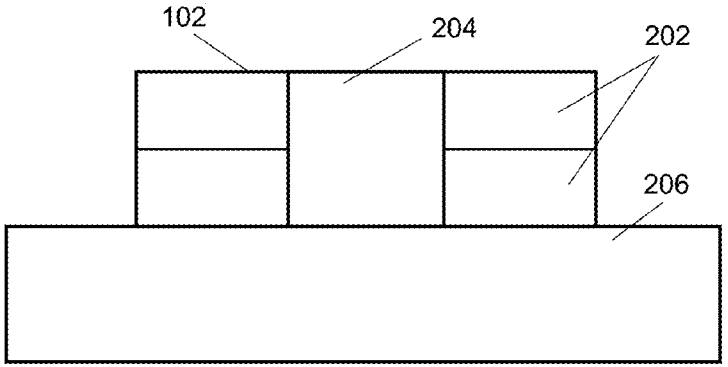
FIG. 2A depicts an exemplary two-turn print head positioned adjacent to a magnetizable material.

FIG. 2A depicts a cross sectional view of an exemplary two-turn print head 102 comprising two layers of a flat conductor 202 (e.g., copper) about a hole (or aperture) 204 positioned at a location on a magnetizable material 206 at which a maxel is to be printed. A two-turn print head is also described in relation to FIGS. 70C-70G of U.S. Pat. No. 8,179,219, which was previously incorporated by reference. One skilled in the art will recognize that the number of turns of a print head may be varied.

FIG. 2B depicts a cross sectional view of exemplary flux density contours 208 corresponding to an exemplary magnetic field 210 produced by the exemplary print head 106 of FIG. 2A when an amount of current is supplied to the print head by a monopolar circuit 100 or a bipolar magnetization circuit 104 such as previously described.

As is well known, magnetizable material can be either anisotropic or isotropic. Magnetic anisotropy is the directional dependence of a material's magnetic properties. The magnetic moment of magnetically anisotropic materials will tend to align with an "easy axis", which is an energetically favorable direction of magnetization. As such, magnets made using anisotropic material are typically magnetized along the material's easy axis, although such materials can be magnetized in a direction other than along the easy axis, such has been described in relation to FIGS. 20A and 20B in U.S. Pat. No. 8,648,681, which was previously incorporated by reference. Magnets made from isotropic material can be magnetized from any direction of the material because it has no preferred magnetization direction.

One skilled in the art will recognize that for a given magnetizable material, for example a N42 Neodymium Iron Boron (NIB) anisotropic rare earth permanent magnet material, which is to be positioned adjacent to the hole 204 of the print head 102*a* such as shown in FIG. 2A, a magnetization contour line 212 can be approximated corresponding to a minimum flux density of the magnetic field 210 that is required to magnetize the magnetizable material 206, which can be approximated based on the coercivity of the material 206.

Figure 2C:
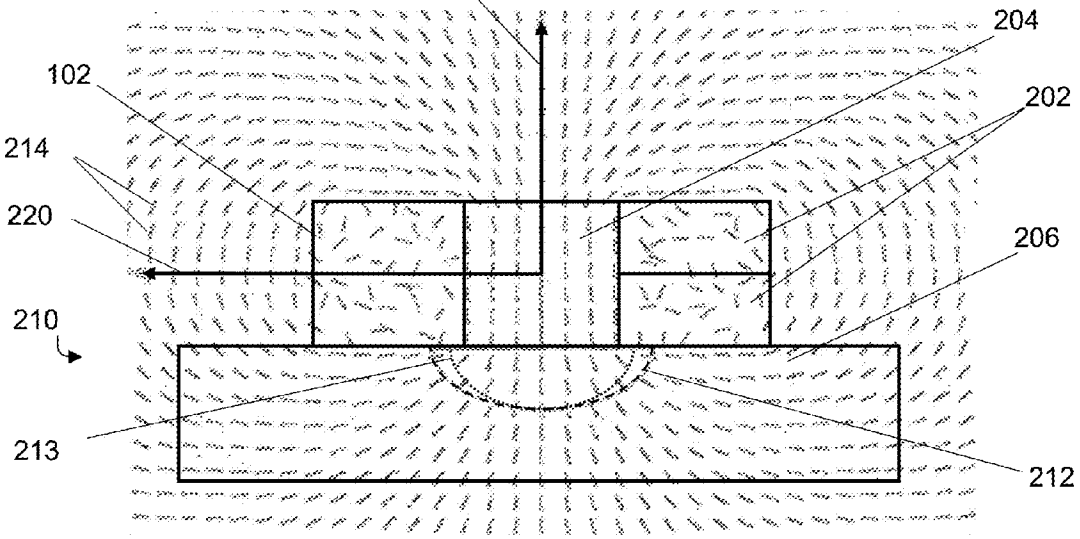
FIG. 2C depicts a cross sectional view of exemplary vectors of flux lines of a magnetic field produced by the exemplary print head of FIG. 2A.

FIG. 2C depicts vectors 214 corresponding to exemplary magnetic flux of the magnetic field 210 of FIG. 2B, where the magnetization contour line 212 of FIG. 2B is shown to indicate a cross-sectional area, which corresponds to a volume, of the material 206, where the flux density of the magnetic field 210 is approximated to be sufficient to print a maxel 216 in the material 206. One skilled in the art will understand that depending on whether the material 206 is anisotropic or isotropic, the extent to which magnetization will occur within the volume also depends on whether the vectors 214 of the magnetic flux of the magnetic field 210 align with the easy magnetization direction (or easy axis) of the material 206. Thus for the example N42 NIB anisotropic material, the amount of magnetization for a given magnetic field strength decreases as the vectors of the magnetic field lines of the magnetic field become more and more misaligned with the easy magnetization direction, where the volume of the material 206 that will be magnetized to become a maxel 216 when taking into account magnetization direction can be approximated by a second magnetization contour line 213. In FIG. 2C the easy magnetization direction of the material is indicated by the up-pointing arrow 218 and the hard magnetization direction is indicated by the left-pointing arrow 220. For isotropic material, where there is no magnetization direction preference, then the second contour line 213 would be substantially similar to the first contour line 212.

Figure 2D:
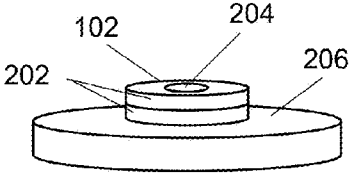
FIG. 2D depicts an oblique projection of the print head and magnetizable material of FIG. 2A.

FIG. 2D depicts an oblique projection of the print head 102 and magnetizable material 206 of FIG. 2A. As shown, the magnetizable material 206 is a disk-shaped material but the material 206 would have a similar cross-section had it been block-shaped.

Figure 3A:
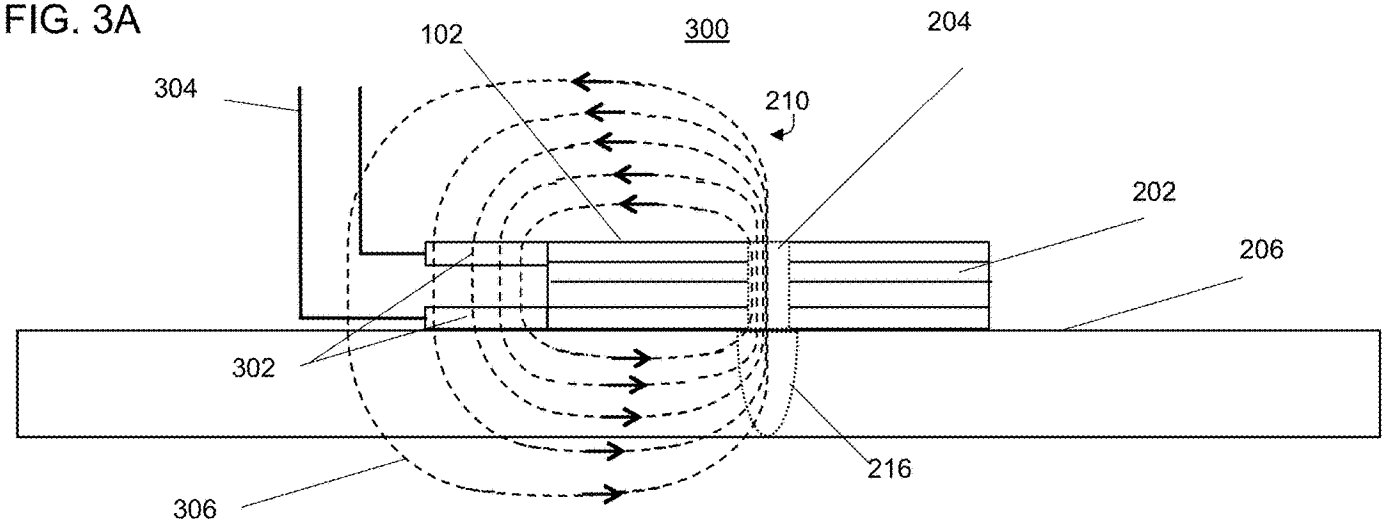
FIG. 3A depicts a cross sectional view of the left half of an exemplary magnetic field of an exemplary four turn print head.

FIG. 3A depicts a cross-sectional view of an exemplary print head 102 comprising four layers 202 of a flat conductor configured to produce multiple turns about a hole 204 positioned at a location on a magnetizable material 206 at which a maxel 216 is being printed and also depicts the magnetic field lines 306 of the left half of an exemplary magnetic field 210. The right side of the magnetic field 210, which is substantially a mirror image of the left side, is not shown to provide some clarity regarding the location of the printed maxel 216. Referring to FIG. 3A, tabs 302 are shown attached to the top and bottom layers 202 of the print head 102. The tabs 302 are supplied an amount of current via supply lines 304 of a monopolar magnetization circuit 100 or a bipolar magnetization circuit 104 such as previously described. Depending on the direction of the supplied current, the magnetic field 210 has a first polarity direction inside the hole or has a second polarity direction inside the hole, which determines the polarity direction of the maxel 216 printed on (and in) the material 206. A four layer print head is also described in relation to FIGS. 19A through 19P of U.S. Pat. No. 8,648,681, which was previously incorporated by reference.

Figure 3B:
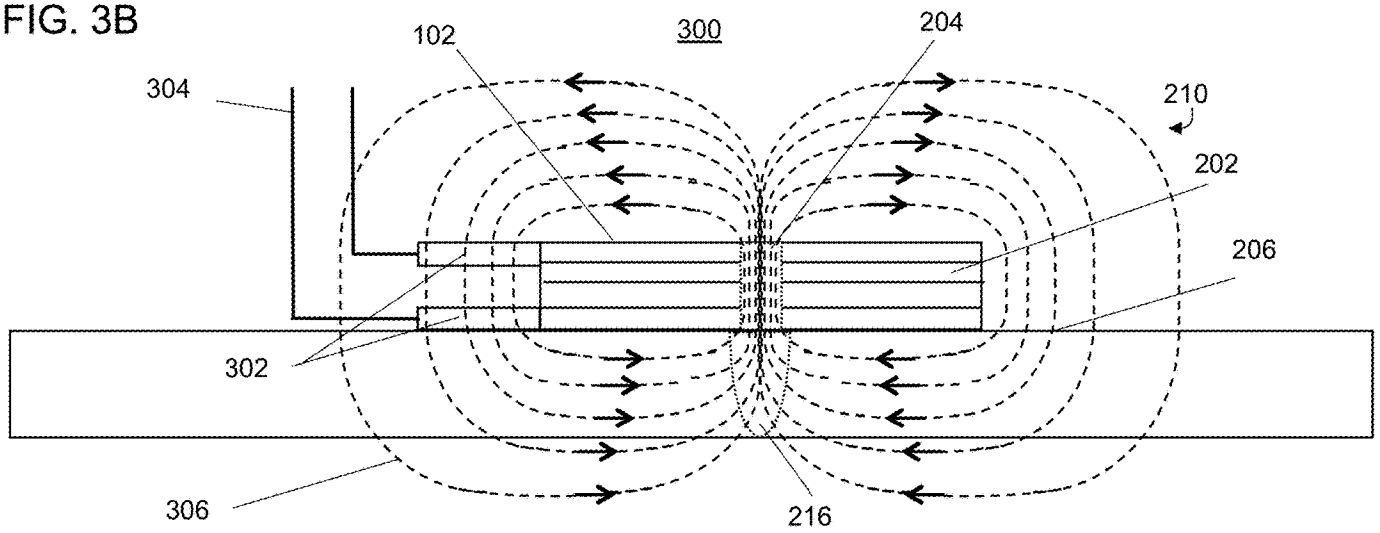
FIG. 3B depicts a cross section view of the exemplary magnetic field of the exemplary four turn print head of FIG. 3A.

FIG. 3B is the same as FIG. 3A except the right side of the magnetic field 210 is also shown.

Figure 3C:
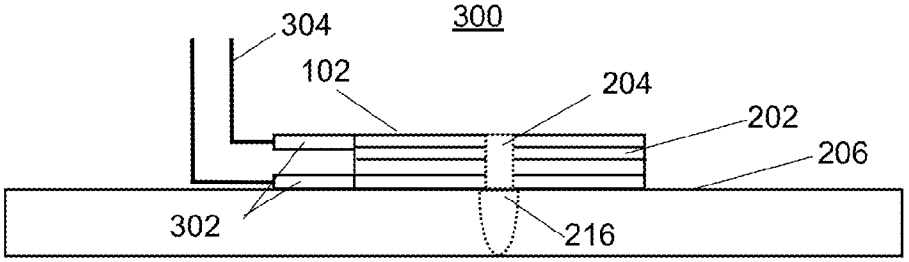
FIGS. 3C-3E depict representations of exemplary maxels produced when the same print head produces the same magnetic field to magnetize maxels in three different thicknesses of the same magnetizable material.

FIG. 3C corresponds to the FIGS. 3A and 3B but does not show the magnetic field. In FIG. 3C, the maxel 216 is represented by a parabolic shape that extends from the side of the magnetizable material 206 that is adjacent to the print head 102 to the opposite side of the material 206. Assuming the print head 102 is round and has a round hole, the maxel volume can be represented by a paraboloid shape, which is merely intended to approximate the shape of the maxel.

Figure 3D:
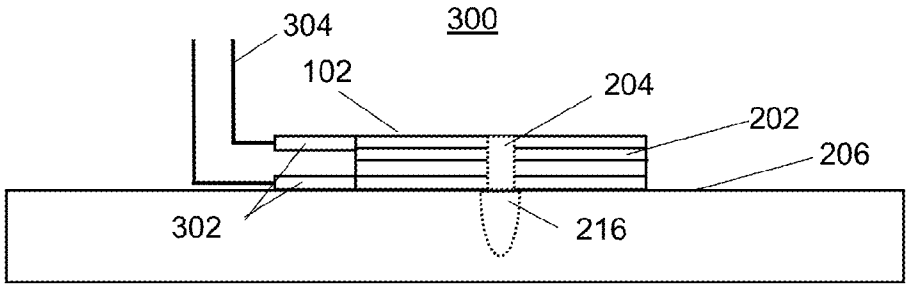

FIG. 3D corresponds to FIG. 3C except the material 206 is thicker. As such, for the same magnetic field, the maxel 216 that is shown no longer extends to the opposite side of the material 206.

Figure 3E:
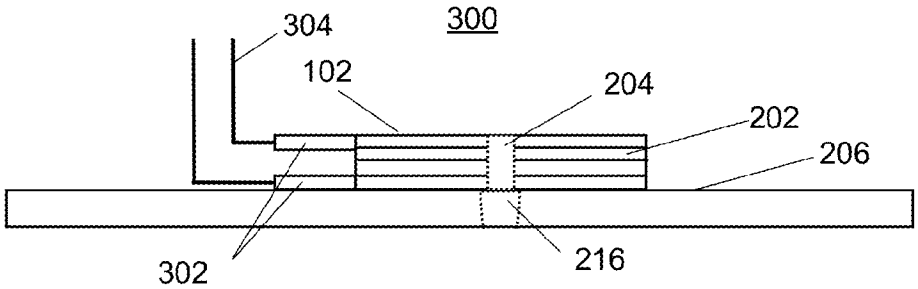

FIG. 3E corresponds to FIG. 3C except the material 206 is thinner. As such, for the same magnetic field, the maxel 216 is represented by the upper portion of the parabolic shape shown in FIG. 3C.

Figure 3F:
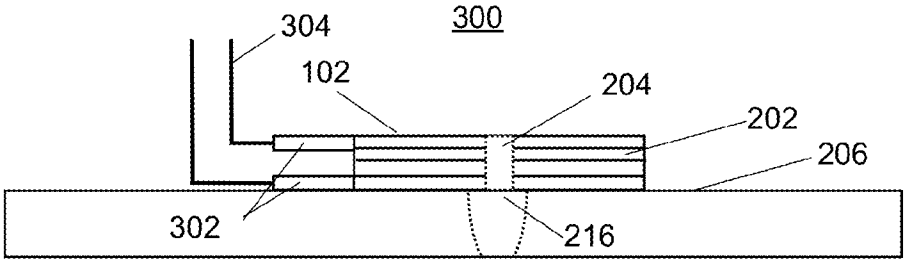
FIGS. 3F-3G depict representations of exemplary maxels produced when the same print head used in FIGS. 3C-3E produces a stronger magnetic field to magnetize maxels in the three different thicknesses of the same magnetizable material.
Figure 3G:
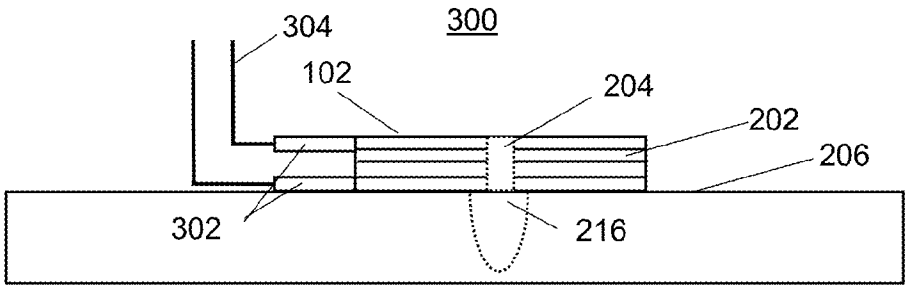
Figure 3H:
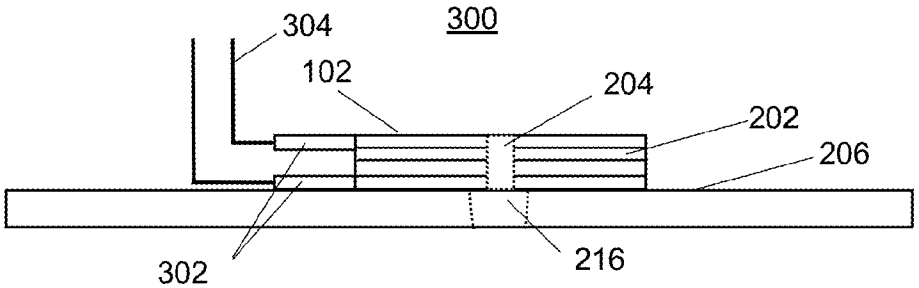
FIGS. 3I-3K depict representations of exemplary maxels produced when the print head and magnetic fields of FIGS. 3C-3E are used to magnetize opposing sides of the three different thicknesses of the same magnetizable material.

FIGS. 3F-3H correspond to FIGS. 3C-3E but depict larger-sized maxels 216 than those shown in FIGS. 3C-3E, which are produced when a stronger magnetic field is produced by the print head 102 as a result of a greater amount of current being supplied to the print head 102. Referring back to FIGS. 2B and 2C, one skilled in the art will understand that the stronger the field strength of the magnetic field produced by a print head 102, the greater the cross-sectional area (and corresponding volume) of the magnetization contour lines 212 and 213 for magnetizing a maxel 216 in a given adjacent magnetizable material 206.

Figure 3I:
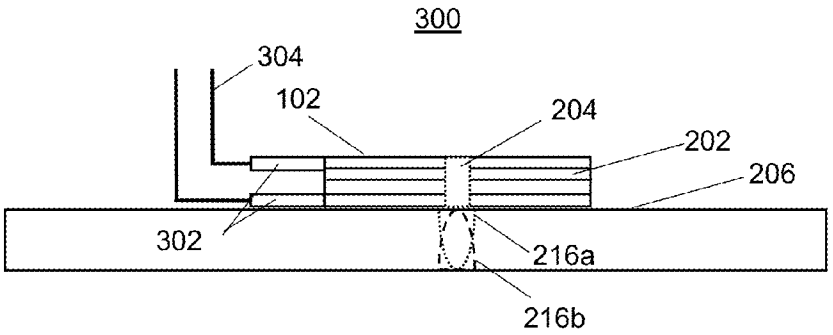
Figure 3J:
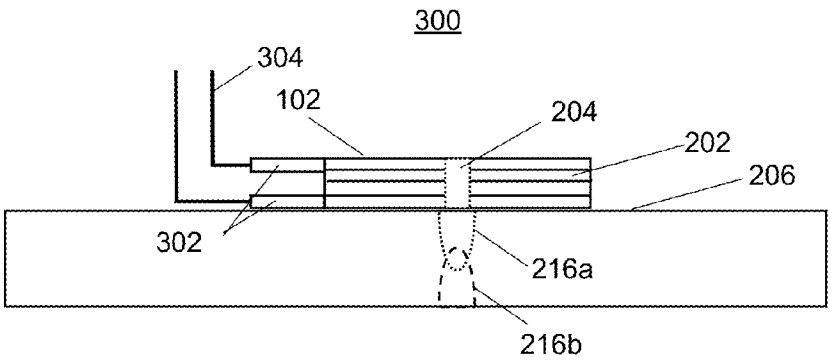
Figure 3K:
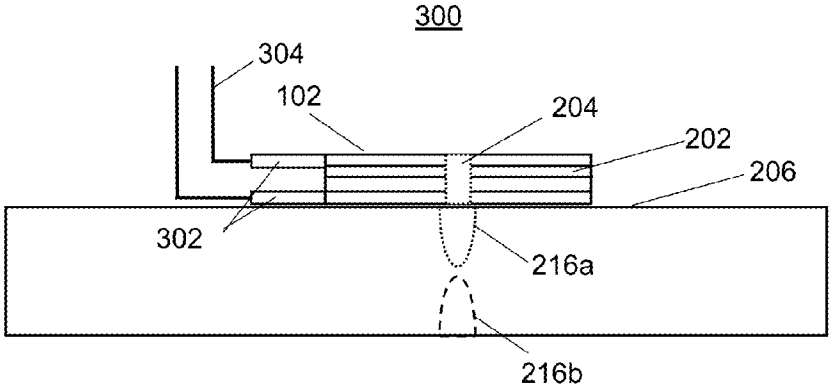

FIGS. 3I-3K correspond to FIG. 3C-3E where maxels 216*a* are shown that have been printed using a print head 102 located adjacent to a first side of the material 206 and using a first magnetic field. Corresponding maxels 216*b* are shown that have been printed using a print head 102 located adjacent to a second side of the material 206 and using a second magnetic field having a field strength substantially the same as the first magnetic field, where the two maxels

216*a*, 216*b* are aligned such that extend towards each other. As indicated by FIG. 3I-3K, for a given magnetic field strength, the maxels 216*a*, 216*b* may or may not overlap to some extent depending on the thickness of the material 206. One skilled in the art will recognize that the maxels 216*a*, 216*b* can be printed, for example, by printing the first maxel 216*a*, turning the material over, and printing the second maxel 216*b*. Alternatively, a first print head can be positioned adjacent to the first side of the material to print the first maxel 216*a* and then a second print head can be positioned adjacent to the second (i.e., opposite) side of the material to print the second maxel 216*b*.

Figure 4B:
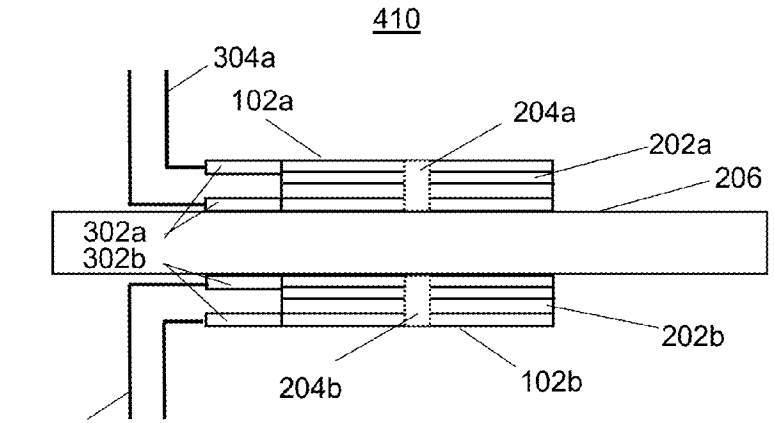
FIG. 4B depicts an alternative exemplary dual-sided maxel printing system comprising two print heads driven independently that are positioned on opposite sides of a magnetizable material.
Figure 4A:
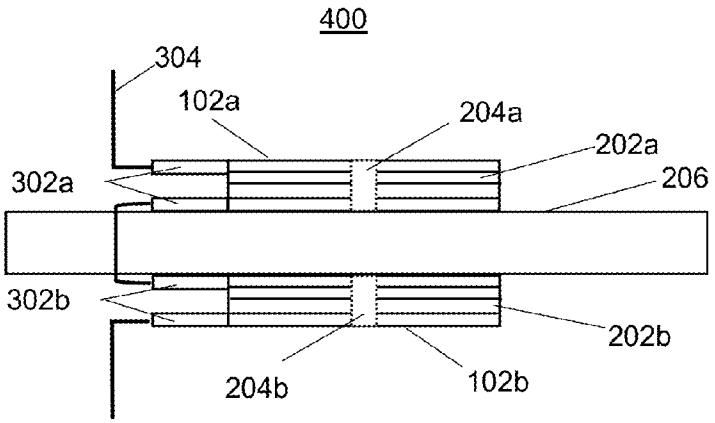
FIG. 4A depicts an exemplary dual-sided maxel printing system comprising two print heads connected in series that are positioned on opposite sides of a magnetizable material.

FIG. 4A depicts an exemplary dual-sided maxel printing system 400 comprising two print heads 102*a* and 102*b* that are connected in series, which are positioned on opposite sides of a magnetizable material 206. Referring to FIG. 4A, the first print head 102*a*, having multiple layers of a flat conductor 202*a* and, in this embodiment, a hole 204*a*, is positioned on a first side of the magnetizable material 206 at a location where a maxel is to be printed. A second print head 102*b*, having multiple layers of a flat conductor 202*b* and, in this embodiment, a hole 204*b*, is positioned on a second side of the magnetizable material 206 at a location where a maxel is to be printed, where the respective holes 204*a* and 204*b* are substantially aligned with each other. The first and second print heads 102*a* and 102*b* have respective tabs 302*a* and 302*b* that are connected in series to a magnetizing circuit via a supply line 304. One skilled in the art will understand that when the print heads 102*a* and 102*b* are connected in series that the print heads will have the same (or matched) impedance. Moreover, they may be configured to produce magnetic fields having substantially the same field strengths when substantially the same amount of current is supplied to each of the two print heads.

FIG. 4B depicts an alternative exemplary dual-sided maxel printing system 410 comprising two print heads 102*a* and 102*b* that are driven independently, which are positioned on opposite sides of a magnetizable material 206. Referring to FIG. 4A, the print heads 102*a* and 102*b* are configured in the same manner as with the two print heads 102*a* and 102*b* of the dual-sided maxel printing system 400 of FIG. 4*a* except their respective tabs 302*a* and 302*b* are connected to separate magnetizing circuits via supply lines 304*a* and 304*b*. One skilled in the art will understand that because the print heads are driven independently they may or may not be configured to have matched impedance. They also may be supplied the same or different amounts of current having the same or different directions for the same or different durations (i.e., pulse widths) and therefore may produce magnetizing fields having, for example, various combinations of the same or different magnetic field strengths, the same or different durations, and/or the same or different polarity directions.

Figure 4D:
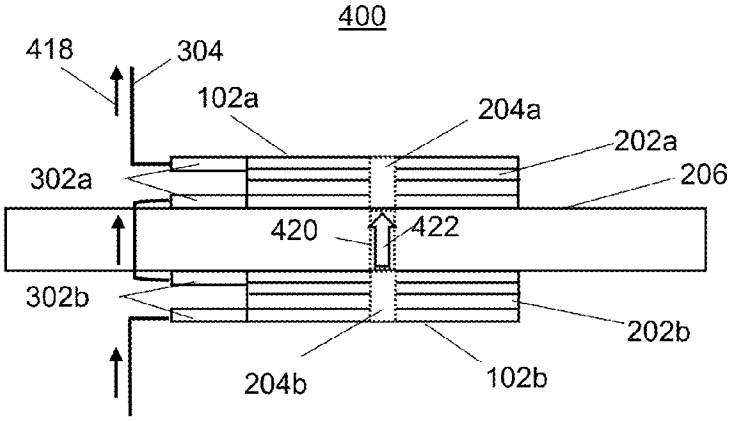
FIG. 4D depicts a representation of a magnetic field produced by the exemplary dual-sided maxel printing system when a current having a second direction is applied.
Figure 4C:
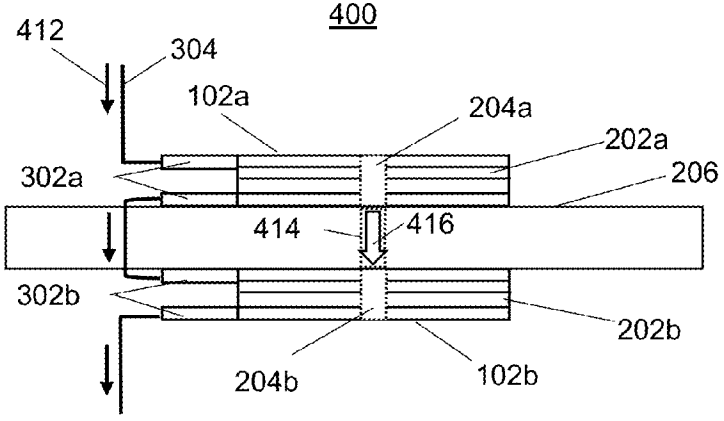
FIG. 4C depicts a representation of a magnetic field produced by the exemplary dual-sided maxel printing system when a current having a first direction is applied.

FIG. 4C depicts a representation of a magnetic field produced by the exemplary embodiment of a dual-sided maxel printing system 400 of FIG. 4A when a current having a first direction is applied to the print heads 102*a* and 102*b*. Referring to FIG. 4C, down arrows 412 to the left of the supply line 304 indicate a first direction of applied current and a corresponding outlined column 414 and outlined down arrow 416 between the two holes 204*a* and 204*b* of the two print heads 102*a* and 102*b* are intended to represent a magnetic field having a first magnetization direction.

FIG. 4D depicts a representation of a magnetic field produced by the exemplary dual-sided maxel printing system 400 of FIG. 4A when a current having a second direction is applied to the print heads 102*a* and 102*b*. Referring to FIG. 4D, up arrows 418 to the left of the supply line 304 indicate a second direction of applied current and a corresponding outline column 420 and outlined up arrow 422 between the two holes 204*a* and 204*b* of the two print heads 102*a* and 102*b* are intended to represent a magnetic field having a second magnetization direction.

FIG. 5A depicts a cross-sectional view of an exemplary magnetic flux lines 306 of an exemplary magnetic field 210 produced by a wire loop 502.

FIG. 5B depicts a cross-sectional view of an exemplary magnetic flux lines 306 of an exemplary magnetic field 210 produced by an exemplary eight turn solenoid coil 504.

FIG. 5C depicts a cross-sectional view of an exemplary magnetic flux lines 306 of an exemplary magnetic field 210 produced by an exemplary single axis Helmholtz coil system 506 comprising two identical circular N-turn solenoid coils 508*a* and 508*b* configured along a common axis, where there is a substantially uniform portion of the magnetic field between the solenoid coils 506.

FIG. 5D depicts an oblique projection of an exemplary single axis Helmholtz coil system 506 comprising two identical four-turn solenoid coils 508*a* and 508*b* configured along a common axis 510.

Figure 6A:
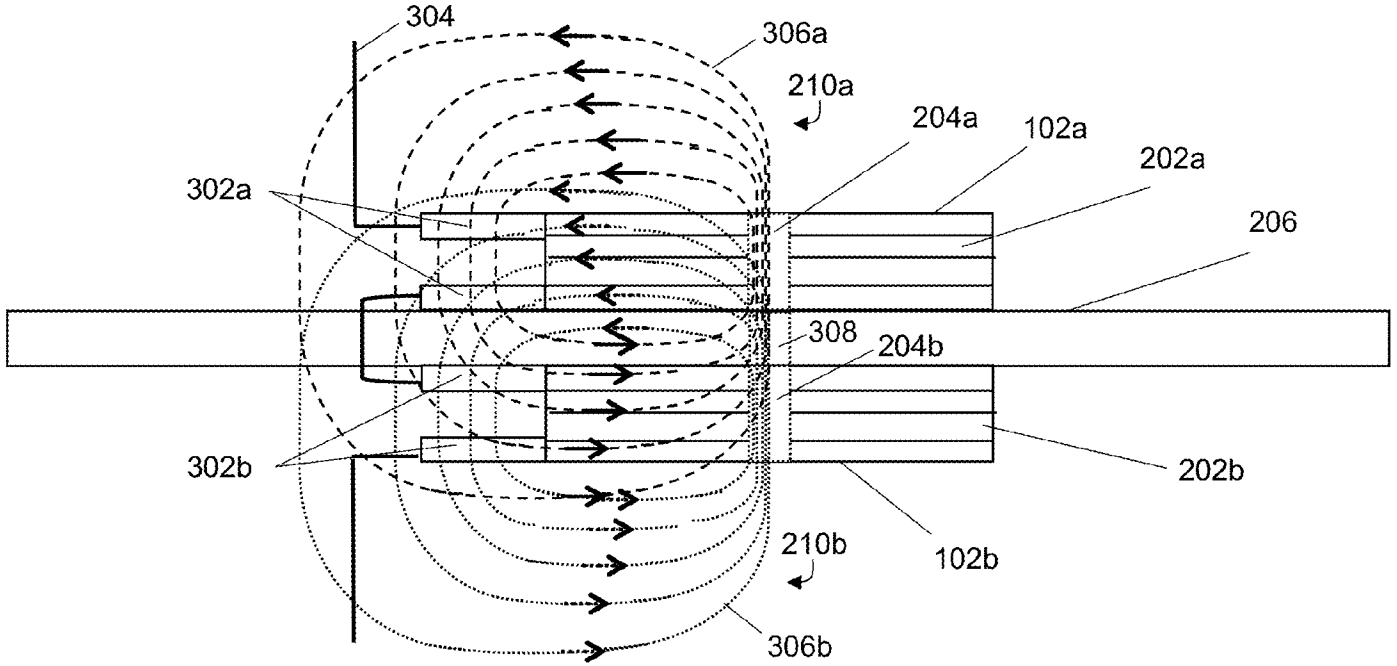
FIGS. 6A-6F depict exemplary magnetic flux lines of magnetic fields produced by an exemplary dual-sided maxel printing system magnetizing six different thicknesses of a magnetizable material.

FIGS. 6A-6F depict cross-sectional views of exemplary magnetic flux lines 306*a* and 306*b* of the left halves of respective magnetic fields 210*a* and 210*b* produced by print heads 102*a* 102*b* of an exemplary dual-sided maxel printing system 400 magnetizing six different thicknesses of a magnetizable material 206. The right halves of the two magnetic fields 210*a* and 210*b*, which are mirror images of the left halves, are not shown for clarity reasons. As depicted in FIG. 6A, when the holes 204*a* and 204*b* of the print heads 102*a* and 102*b* are aligned along a common axis like the solenoid coils 508*a* and 508*b* of FIGS. 5C and 5D, the magnetic fields 210*a* and 210*b*, which are represented by dashed magnetic flux lines 306*a* and dotted magnetic flux lines 306*b*, combine to produce a substantially uniform magnetic field within a cylindrical-shaped volume 308 of the material 206 that is between the holes 204*a* 204*b* of the print heads 102*a* and 102*b*. However, as depicted in FIGS. 6B-6F, the magnetic field begins to separate into two portions for increasing thicknesses of the material 206 being magnetized.

Figure 7A:
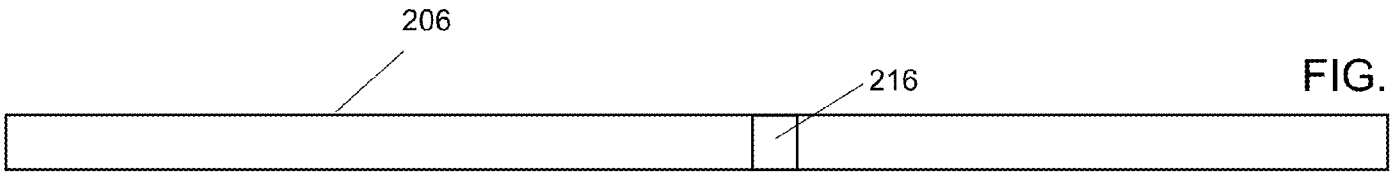
FIGS. 7A-7F depict exemplary representations of maxels produced by the magnetic fields of FIGS. 6A-6F.
Figure 6B:
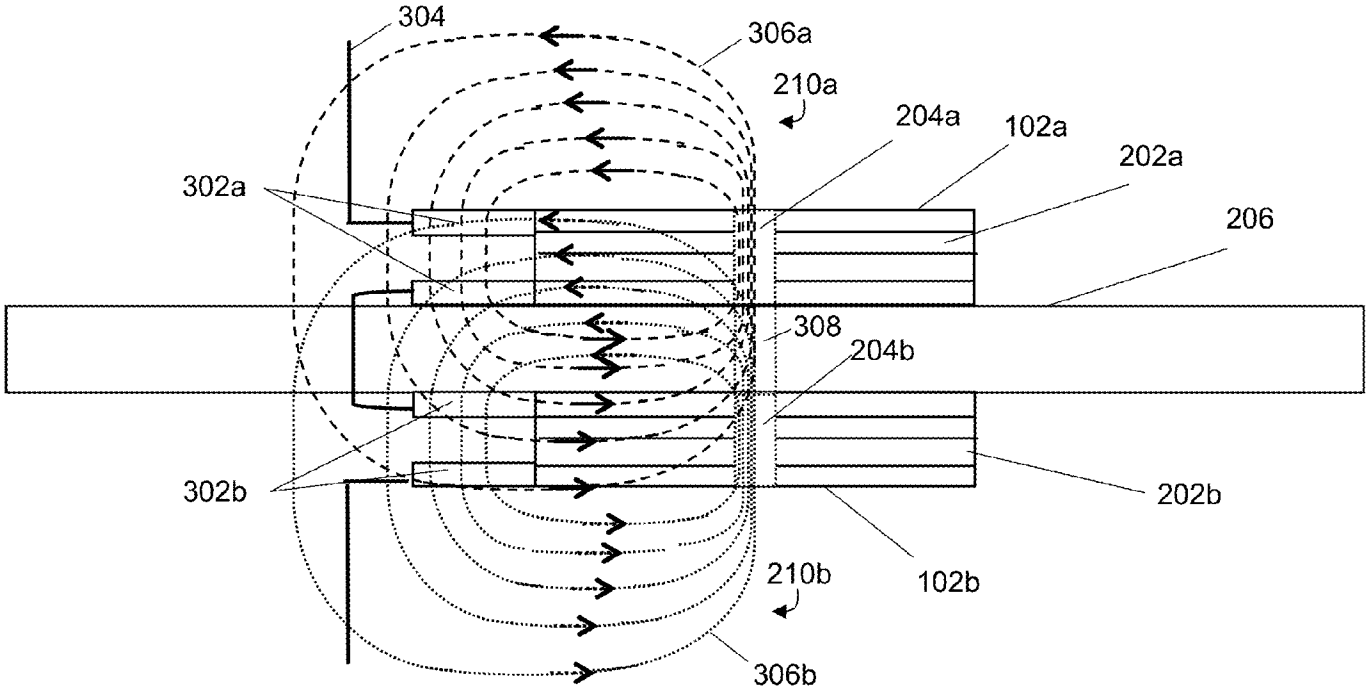
Figure 7B:
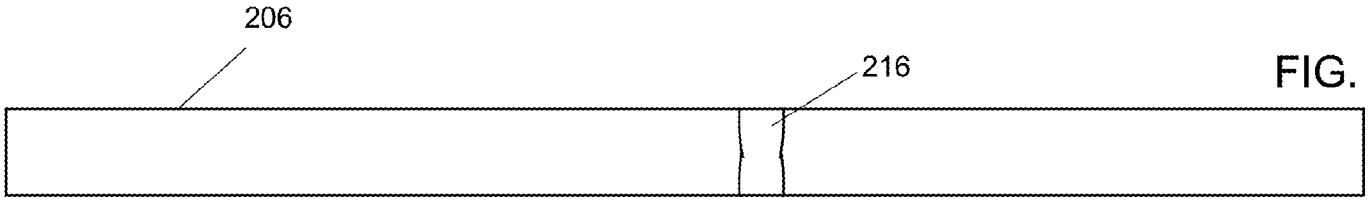
Figure 6C:
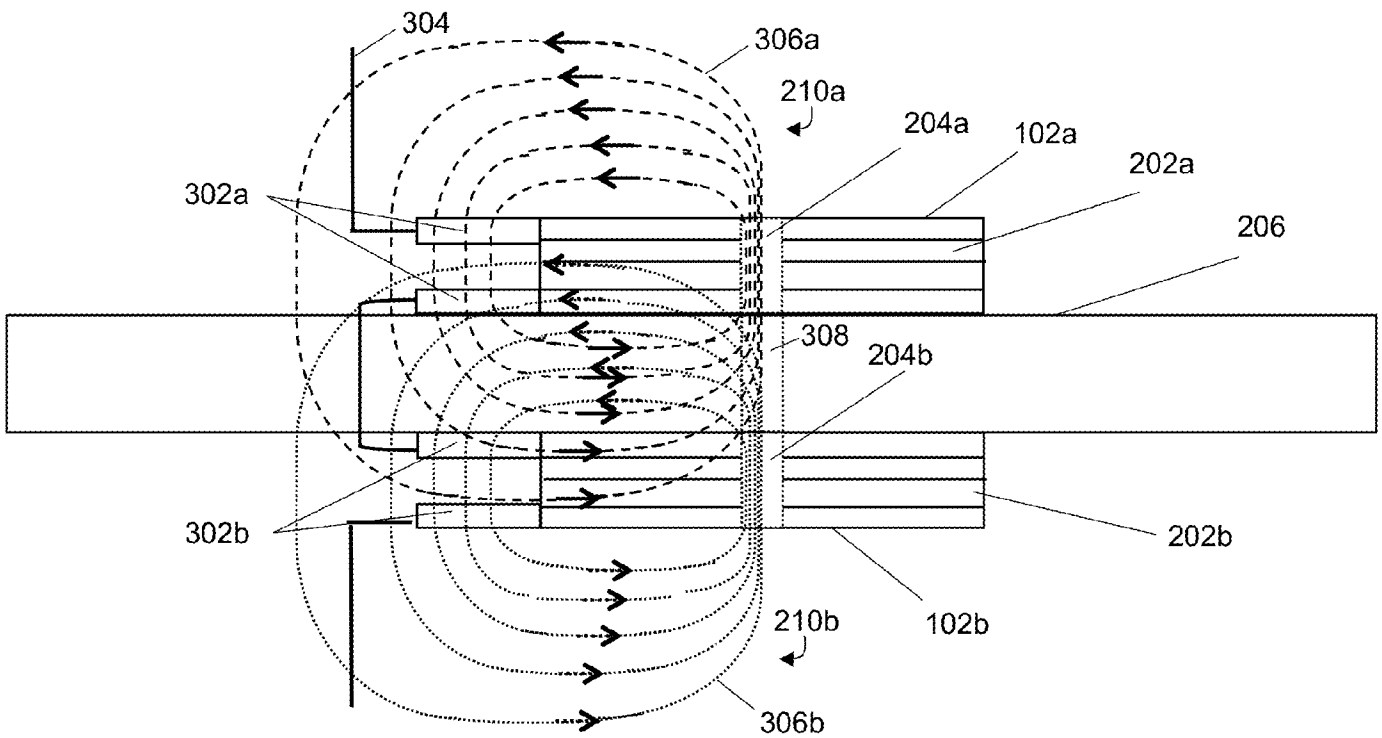
Figure 7C:
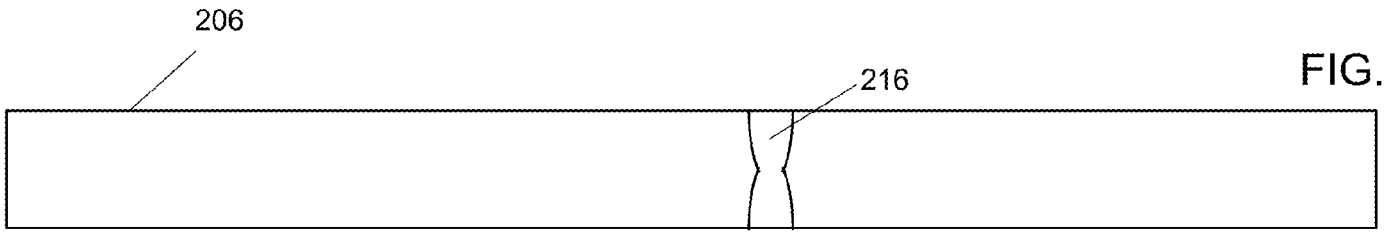
Figure 6D:
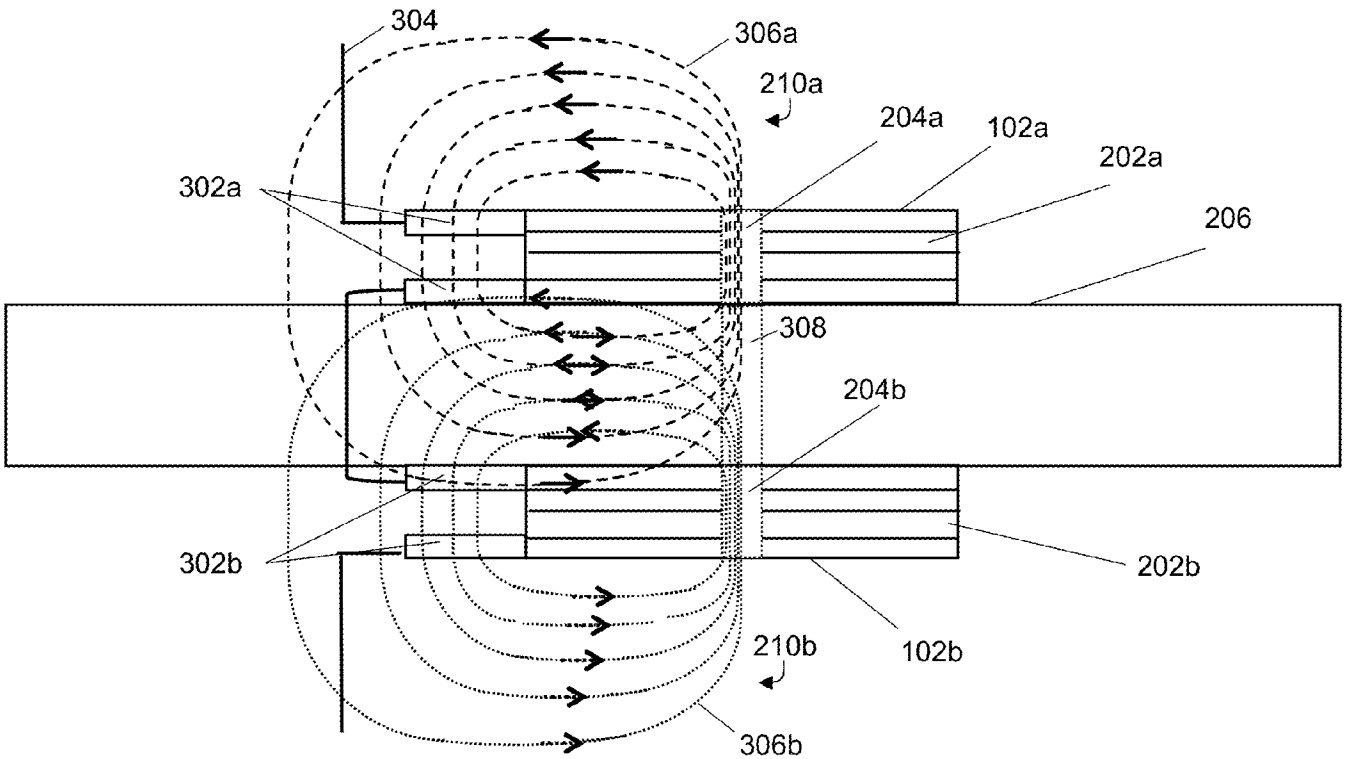
Figure 7D:
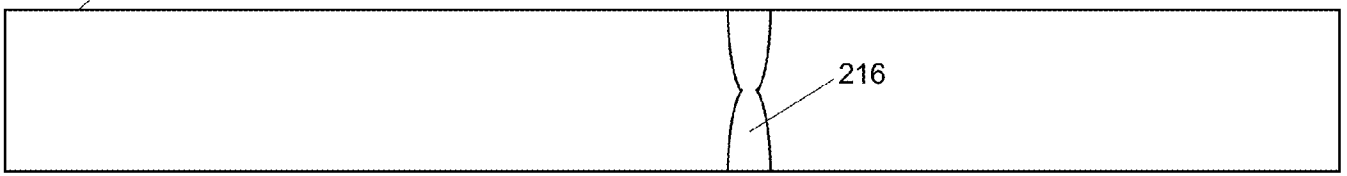
Figure 6E:
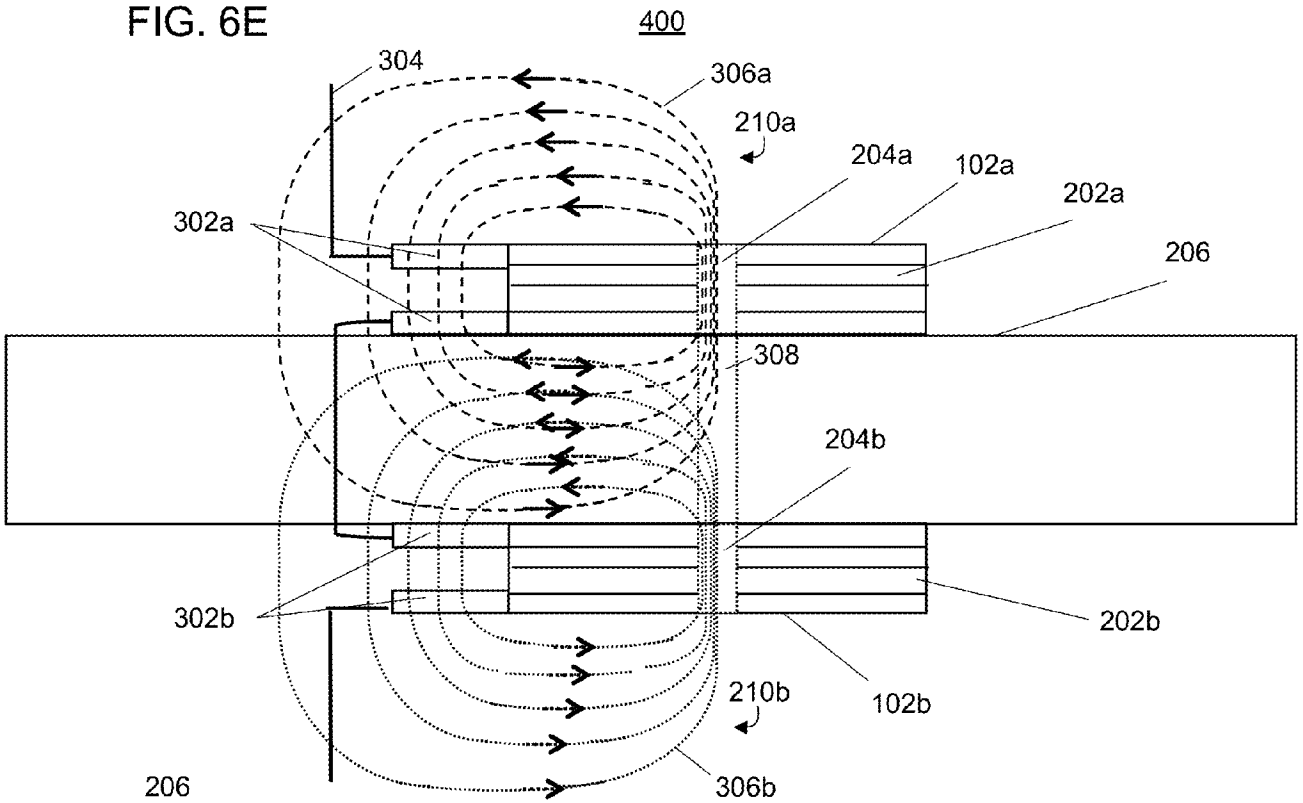
Figure 7E:
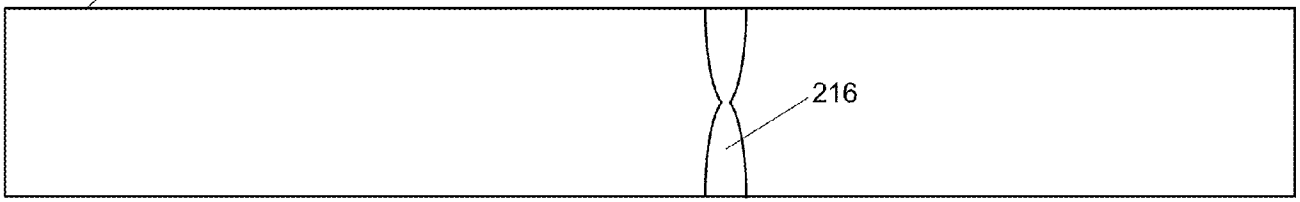
Figure 6F:
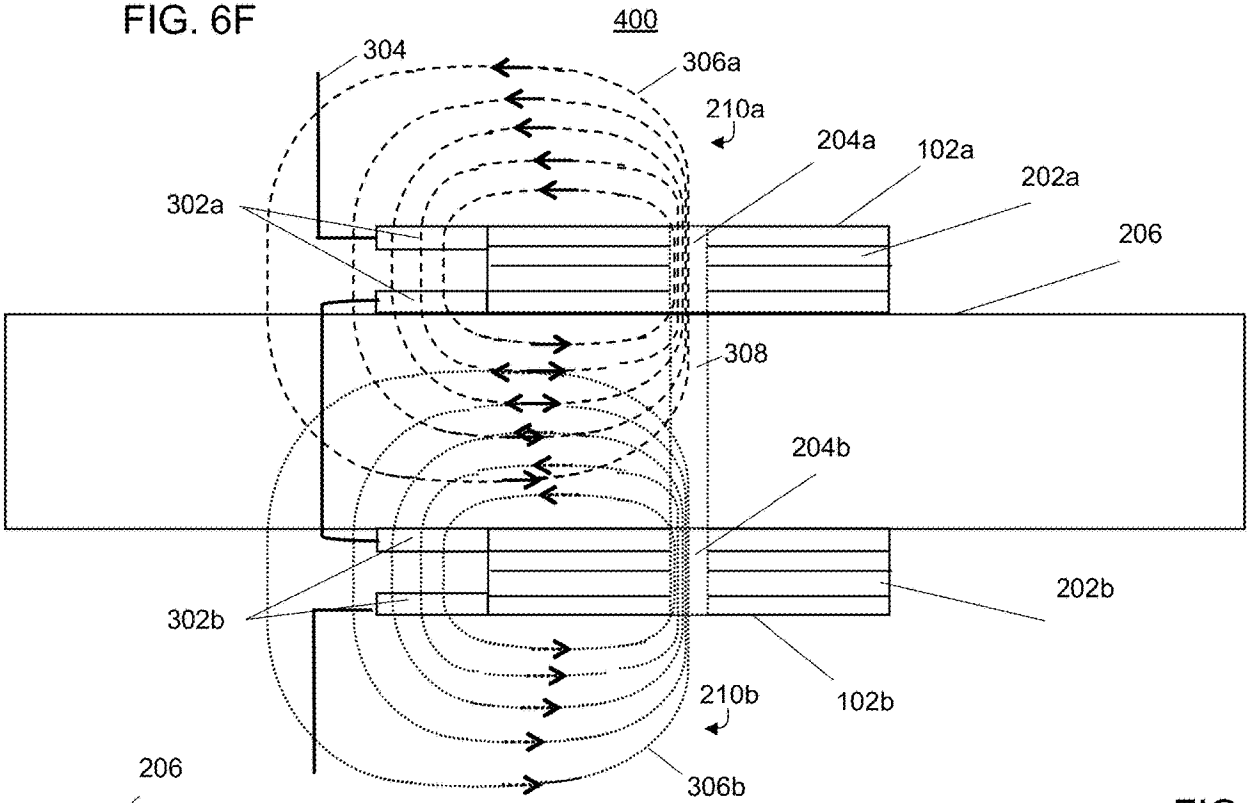
Figure 7F:
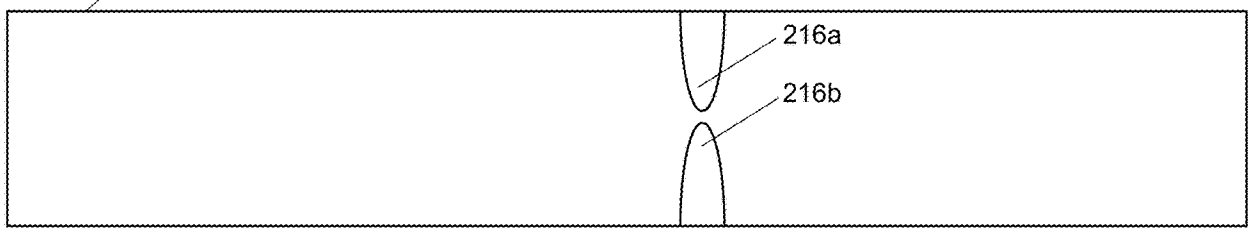

FIGS. 7A-7F depict exemplary representations of maxels 216 produced by the magnetic fields 210*a* 210*b* of the print heads 102*a* 102*b* of FIGS. 6A-6F. As seen in FIG. 7A, the magnetic fields 210*a*-210*b* of FIG. 6A produce a maxel 216 having a substantially rectangular cross section, which would correspond to a substantially cylindrical volume within the material 206. However, as the material 206 becomes successively thicker, as depicted in FIGS. 7B-7F, the resulting maxel 216 begins to become shaped somewhat like an hour glass until the maxel become separated into two distinct maxels 216*a* and 216*b* in FIG. 7F. One skilled in the art will recognize that, for magnetic fields 210*a* and 210*b* having a given magnetic field strength produced by the two print heads 102*a* and 102*b* and for a given material 206 having a certain coercivity properties, the flux lines produced in the material 206 will at some point separate as the print heads 102*a* and 102*b* are separated as a result of them being on opposite sides of successively thicker material 206.

Figure 8A:
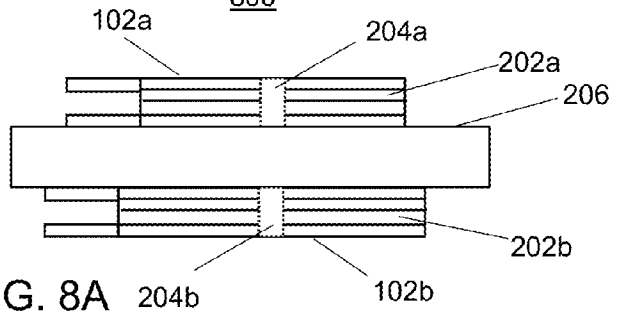
FIG. 8A depicts an exemplary dual-sided maxel printing system comprising print heads having different coil diameters but having apertures with the same diameter.

Whether or not separate magnetizing circuits are used, the print heads of a dual-sided maxel printing system can have various differences in geometry. FIGS. 8A-8O depict various exemplary dual-sided maxel printing system having print head having different geometries where the magnetic fields produced by the first and second print heads of a given system may or may not have the same field strength and the magnetic fields produced by the first and second print heads of a given system may have the same polarity direction or an opposite polarity direction.

FIG. 8A depicts an exemplary dual-sided maxel printing system 800 comprising print heads 102*a* and 102*b* having different coil diameters but having apertures with the same diameter. Referring to FIG. 8A, the coil diameter of the first print 102*a* is shown to be less than the coil diameter of the second print head 102*b* while the apertures 204*a* and 204*b* are shown to have the same diameter, where the respective apertures 204*a* and 204*b* are aligned along a common axis. Also, the aperture diameter to coil diameter ratio of the first print head 102*a* is greater than the aperture diameter to coil diameter ratio of the second print head 102*a*.

Figure 8B:
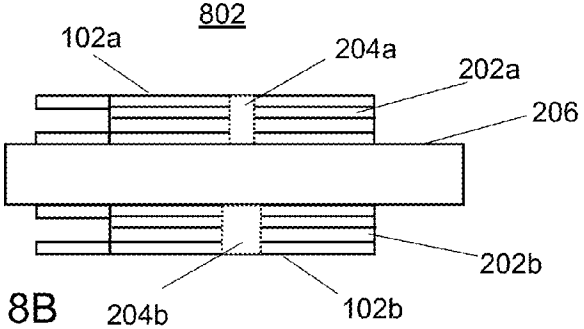
FIG. 8B depicts an exemplary dual-sided maxel printing system comprising print heads having the same coil diameters but having apertures with different diameters.

FIG. 8B depicts an exemplary dual-sided maxel printing system 802 comprising print heads 102*a* and 102*b* having the same coil diameters but having apertures with different diameters. Referring to FIG. 8B, the coil diameter of the first print 102*a* is shown to be the same as the coil diameter of the second print head 102*b* while the diameter of the aperture 204*a* of the first print 102*a* is less than the diameter of the aperture 204*b* of the second print head 102*b*, where the respective apertures 204*a* and 204*b* are aligned along a common axis. Also, the aperture diameter to coil diameter ratio of the first print head 102*a* is greater than the aperture diameter to coil diameter ratio of the second print head 102*a*.

Figure 8C:
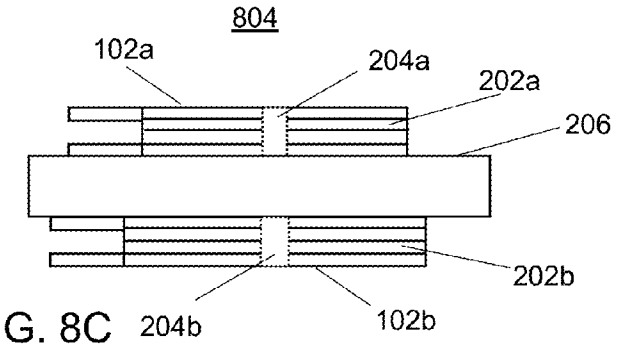
FIG. 8C depicts an exemplary dual-sided maxel printing system comprising print heads having different sizes but having the same aperture diameter to coil diameter ratios.

FIG. 8C depicts an exemplary dual-sided maxel printing system 2014 comprising print heads 102*a* and 102*b* having different sizes but having substantially the same aperture diameter to coil diameter ratios. Referring to FIG. 8C, the coil diameter of the first print 102*a* is shown to be less that the coil diameter of the second print head 102*b* while the diameter of the aperture 204*a* of the first print 102*a* is proportionally less than the diameter of the aperture 204*b* of the second print head 102*b*, where the respective apertures 204*a* and 204*b* are aligned along a common axis. As shown, although the first print head 102*a* is smaller than the second print head 102*b*, the differences in coil diameters and aperture diameters of the two print heads 102*a* and 102*b* are proportional such that the aperture diameter to coil diameter ratios of the two print heads 102*a* and 102*b* are the same.

Figure 8D:
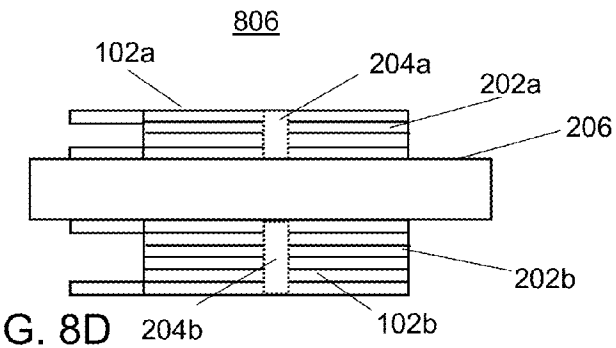
FIG. 8D depicts an exemplary dual-sided maxel printing system comprising print heads having the same aperture diameter to coil diameter ratios but having a different number of coil turns.

FIG. 8D depicts an exemplary dual-sided maxel printing system 806 comprising print heads 102*a* and 102*b* having the same aperture diameter to coil diameter ratios and having conductor layers having the same thicknesses but having a different number of coil layers (or turns). Referring to FIG. 8D, the first print head 102*a* has the same coil diameter as the second print head 102*b* and the two apertures 204*a* and 204*b* of the two print heads 102*a* and 102*b* are the same. As such, the two print heads have the same aperture diameter to coil diameter ratios. However, although the conductor layers 202*a* 202*b* of the respective print heads 102*a* and 102*b* have the same thickness the first print head 102*a* has four layers and the second print head 102*b* has six layers. As such, the depth of the aperture 204*a* of the first print head 102*a* is less than the depth of the aperture 204*b* of the second print head 102*b*.

Figure 8E:
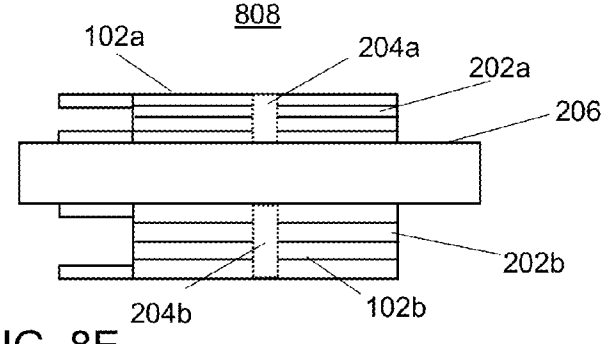
FIG. 8E depicts an exemplary dual-sided maxel printing system comprising print heads having the same aperture diameter to coil diameter ratios and the same number of coil turns but having different layer thicknesses.

FIG. 8E depicts an exemplary dual-sided maxel printing system 808 comprising print heads 102*a* and 102*b* having dimensions similar to those of the system 806 of FIG. 8D except the two print heads 102*a* 102*b* have the same number of conductor layers 202*a* 202*b* but the conductor layers 202*a* of the first print head 102*a* are thinner than the conductor layers 202*b* of the second print head 102*b* such that the depth of the aperture 204*a* of the first print head 102*a* is less than the depth of the aperture 204*b* of the second print head 102*b*. It can be noted that the respective depths of the apertures 204*a* and 204*b* of the first and second print heads 102*a* and 102*b* of the systems 806 and 808 of FIGS. 8D and 8E are the same.

Figure 8F:
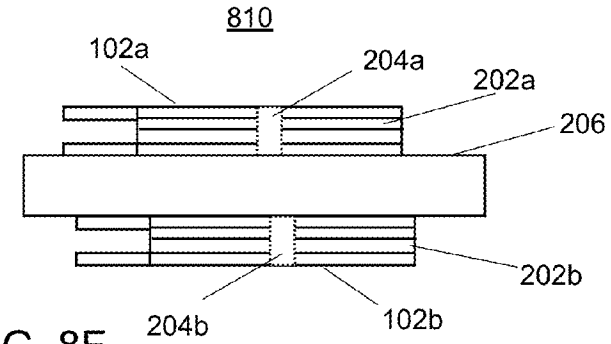
FIG. 8F depicts an exemplary dual-sided maxel printing system comprising print heads that are the same but are misaligned such that their respective apertures are offset from each other.

FIG. 8F depicts an exemplary dual-sided maxel printing system 810 comprising print heads 102*a* and 102*b* that are the same but are misaligned such that their respective apertures are offset from each other so that they are not aligned along a common axis.

Figure 8G:
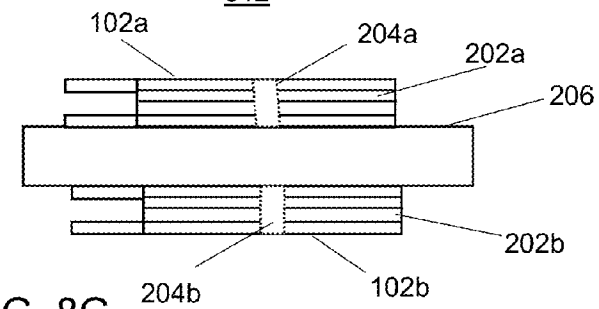
FIG. 8G depicts an exemplary dual-sided maxel printing system comprising a first print head having a vertical aperture and a second print head having an angled aperture.

FIG. 8G depicts an exemplary dual-sided maxel printing system 812 comprising a first print head 102*b* having a vertical aperture 204*b* and a second print head 102*a* having an angled aperture 204*a*.

Figure 8H:
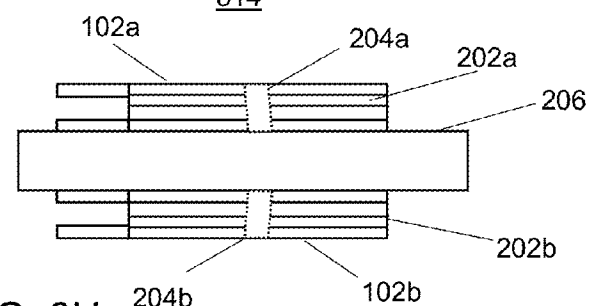
FIG. 8H depicts an exemplary dual-sided maxel printing system comprising a first print head having an angled aperture and a second print head having an angled aperture with an opposite direction as the aperture of the first print head.

FIG. 8H depicts an exemplary dual-sided maxel printing system 814 comprising a first print head 102*a* having an angled aperture 204*a* and a second print head 102*b* having an angled aperture 204*a* with an opposite direction as the aperture 204*a* of the first print head 102*a*.

Figure 8I:
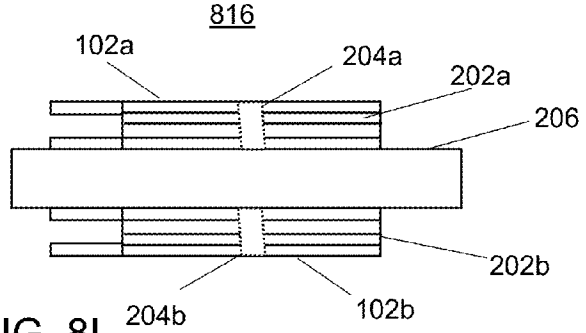
FIG. 8I depicts an exemplary dual-sided maxel printing system comprising a first print head having an angled aperture and a second print head having an angled aperture with the same direction as the aperture of the first print head where the apertures are misaligned.

FIG. 8I depicts an exemplary dual-sided maxel printing system 802 comprising a first print head 102*a* having an angled aperture 204*a* and a second print head 102*b* having an angled aperture 204*b* with the same direction as the aperture 204*a* of the first print head 102*a* where the apertures are misaligned such that are not aligned along a common axis.

Figure 8J:
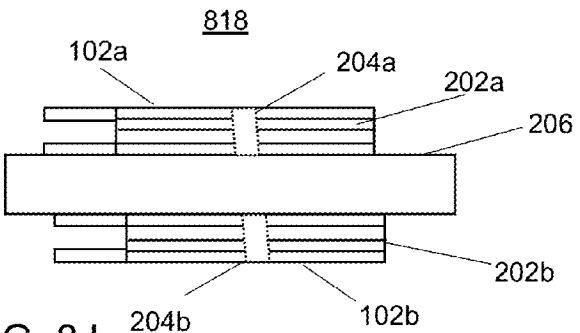
FIG. 8J depicts an exemplary dual-sided maxel printing system comprising a first print head having an angled aperture and a second print head having an angled aperture with the same direction as the aperture of the first print head where the apertures are maligned.

FIG. 8J depicts an exemplary dual-sided maxel printing system 1118 comprising a first print head 102*a* having an angled aperture 204*a* and a second print head 102*b* having an angled aperture 204*b* with the same direction as the aperture 204*a* of the first print head 102*a* where the apertures are aligned along a common axis.

Figure 8K:
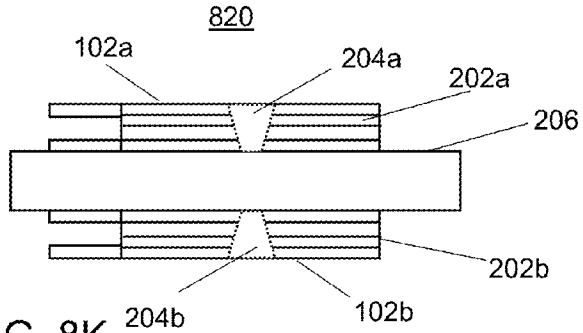
FIG. 8K depicts an exemplary dual-sided maxel printing system comprising print heads having aligned conical apertures.

FIG. 8K depicts an exemplary dual-sided maxel printing system 820 comprising print heads 102*a* 102*b* having conical apertures 204*a* 204*b* aligned along a common axis.

Figure 8L:
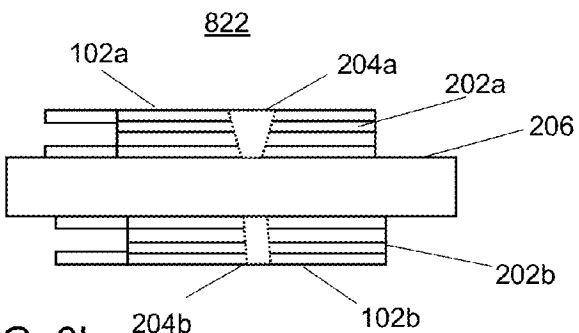
FIG. 8L depicts an exemplary dual-sided maxel printing system comprising a first print head having a conical aperture and a second print head having an angled aperture.

FIG. 8L depicts an exemplary dual-sided maxel printing system 822 comprising a first print head 102*a* having a conical aperture 204*a* and a second print head 102*b* having an angled aperture 204*b*.

Figure 8M:
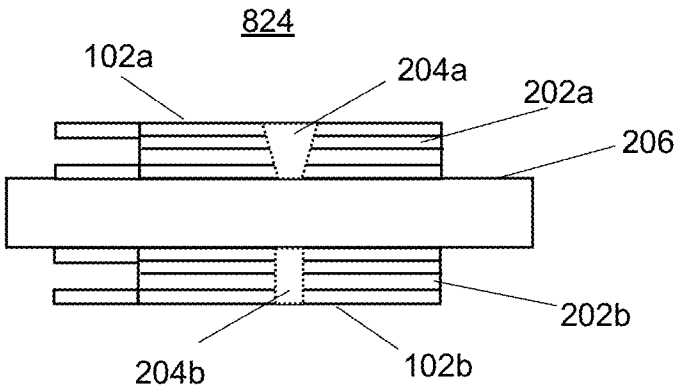
FIG. 8M depicts an exemplary dual-sided maxel printing system comprising a first print head having a conical aperture and a second print head having a vertical aperture.

FIG. 8M depicts an exemplary dual-sided maxel printing system 824 comprising a first print head 102*a* having a conical aperture 204*a* and a second print head 102*b* having a vertical aperture 204*b*.

Figure 8N:
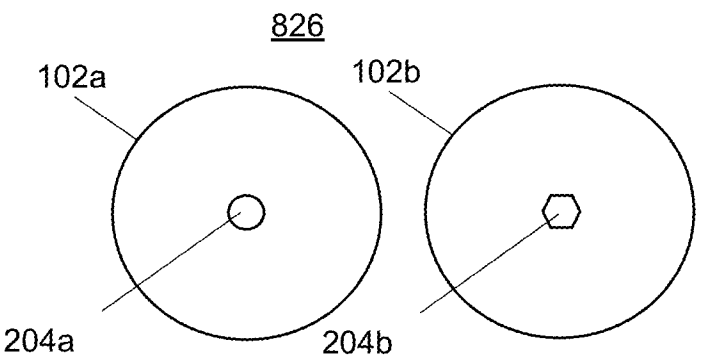
FIG. 8N depicts an exemplary dual-sided maxel printing system comprising a first print head having a circular-shaped aperture and a second print head having a hexagonal-shaped aperture.
Figure 8O:
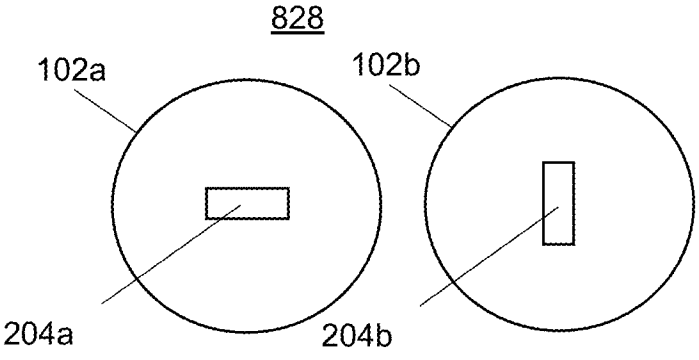
FIG. 8O depicts an exemplary dual-sided maxel printing system comprising a first print head having a rectangular aperture and a second print head also having a rectangular aperture but rotated 90 degrees relative to the first print head.

FIG. 8N depicts an exemplary dual-sided maxel printing system 826 comprising a first print head 102*a* having a circular-shaped aperture 204*a* and a second print head 102*b* having a hexagonal-shaped aperture 204*b*.

FIG. 8O depicts an exemplary dual-sided maxel printing system 828 comprising a first print head 102*a* having a rectangular aperture 204*a* and a second print head 102*b* also having a rectangular aperture 204*b* with the same dimensions but rotated ninety degrees relative to the first print head 102*a*.

Figure 9C:
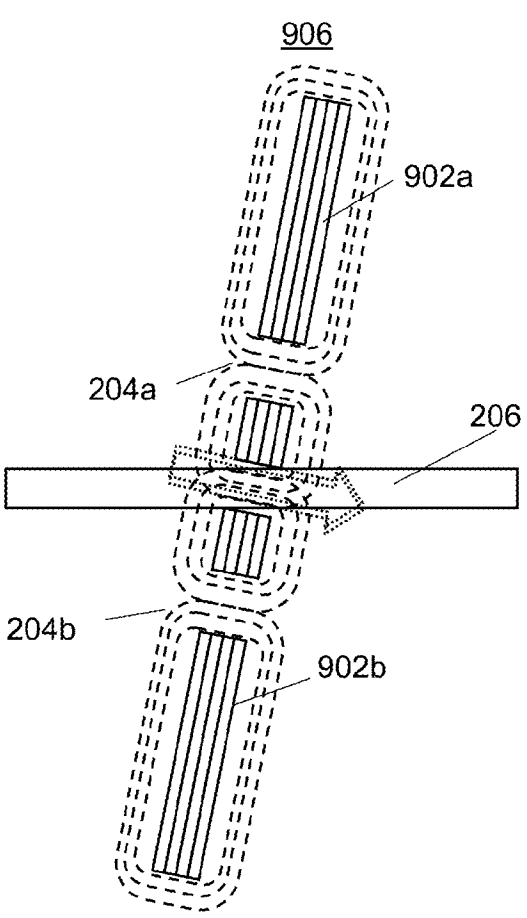
FIG. 9C depicts an exemplary dual-sided maxel printing system comprising two print heads configured to produce a maxel using the at outer coil perimeters, where the print heads are angled and aligned and their magnetic fields partially cancel.
Figure 9B:
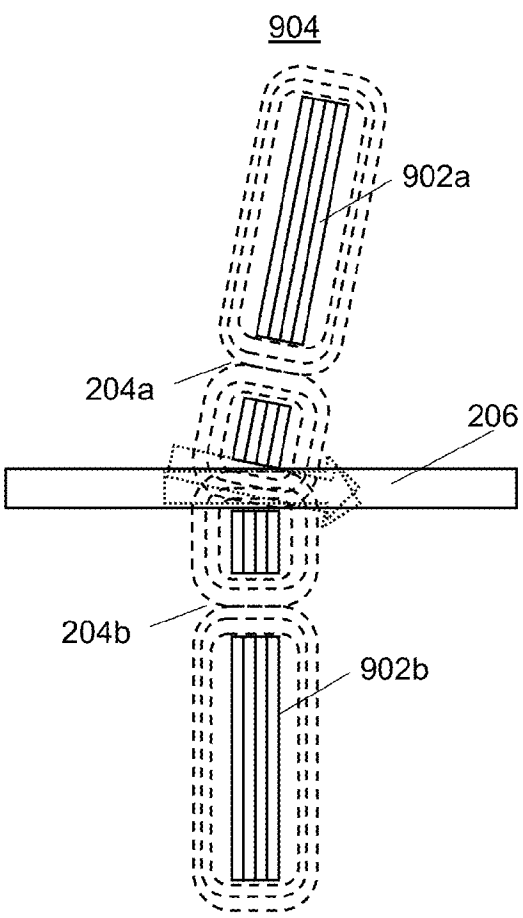
FIG. 9B depicts an exemplary dual-sided maxel printing system comprising two print heads configured to produce a maxel using the fields at outer coil perimeters, where one print head is vertical and one print head is angled but the two print heads are otherwise aligned and their magnetic fields are additive.
Figure 9A:
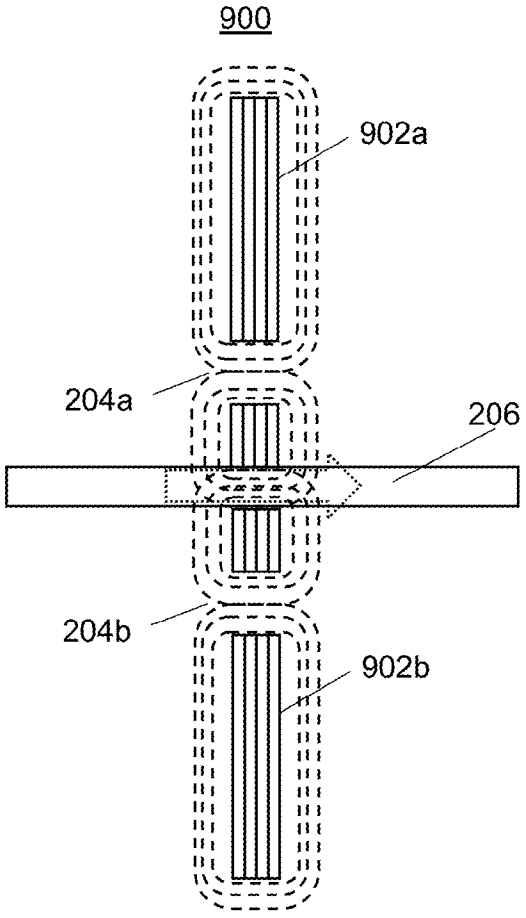
FIG. 9A depicts an exemplary dual-sided maxel printing system comprising two print heads configured to produce a maxel using the fields at outer coil perimeters, where the print heads are aligned vertically and their magnetic fields are additive.

FIG. 9A depicts an exemplary dual-sided maxel printing system 900 comprising two print heads 902*a* and 902*b* configured to produce a maxel using the fields at outer coil perimeters, where the print heads 902*a* and 902*b* are aligned vertically and their magnetic fields are additive.

FIG. 9B depicts an exemplary dual-sided maxel printing system 904 comprising two print heads 902*a* and 902*b* configured to produce a maxel using the fields at outer coil perimeters, where one print head 902*b* is vertical and one print head 902*a* is angled but the two print heads 902*a* and 902*b* are otherwise aligned and their magnetic fields are additive.

FIG. 9C depicts an exemplary dual-sided maxel printing system 906 comprising two print heads 902*a* and 902*b* configured to produce a maxel using the fields at outer coil perimeters, where the print heads 902*a* and 902*b* are angled and aligned and their magnetic fields are additive.

Figure 9F:
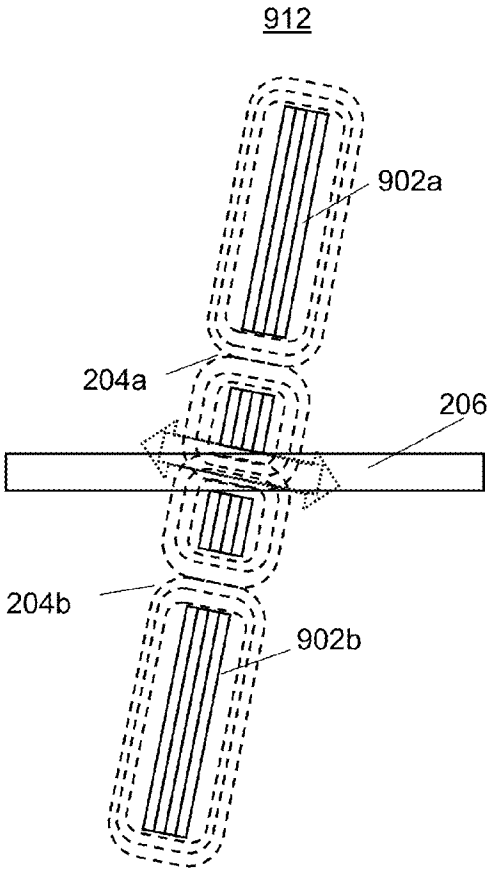
FIG. 9F depicts an exemplary dual-sided maxel printing system comprising two print heads configured to produce a maxel using the fields at outer coil perimeters, where the print heads are angled and aligned and their magnetic fields are subtractive.
Figure 9E:
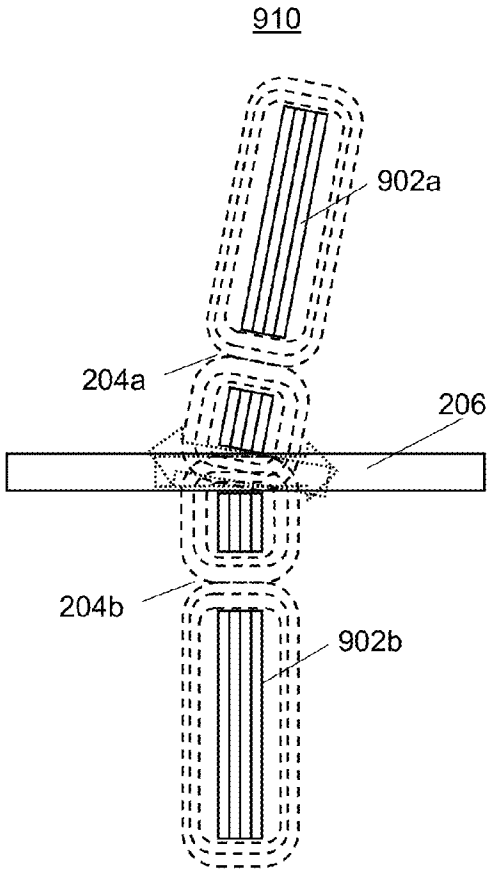
FIG. 9E depicts an exemplary dual-sided maxel printing system comprising two print heads configured to produce a maxel using the fields at outer coil perimeters, where one print head is vertical and one print head is angled but the two print heads are otherwise aligned and their magnetic fields partially cancel.
Figure 9D:
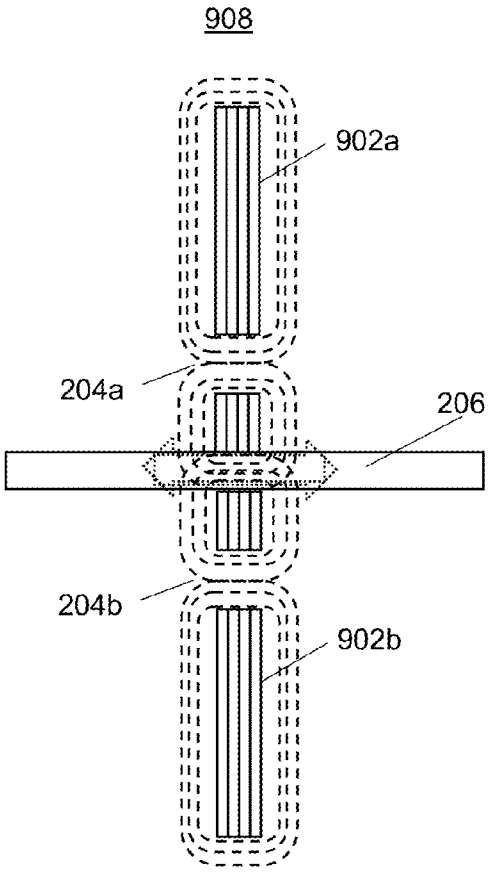
FIG. 9D depicts an exemplary dual-sided maxel printing system comprising two print heads configured to produce a maxel using the fields at outer coil perimeters, where the print heads are aligned vertically and their magnetic fields partially cancel.

FIG. 9D depicts an exemplary dual-sided maxel printing system 908 comprising two print heads 902*a* and 902*b* configured to produce a maxel using the fields at outer coil perimeters, where the print heads 902*a* and 902*b* are aligned vertically and their magnetic fields partially cancel.

FIG. 9E depicts an exemplary dual-sided maxel printing system comprising two print heads configured to produce a maxel using the fields at outer coil perimeters, where one print head is vertical and one print head is angled but the two print heads are otherwise aligned and their magnetic fields partially cancel.

FIG. 9F depicts an exemplary dual-sided maxel printing system comprising two print heads configured to produce a maxel using the fields at outer coil perimeters, where the print heads are angled and aligned and their magnetic fields partially cancel.

FIG. 10A depicts an exemplary dual-sided maxel printing system comprising a first print head configured to produce a maxel using the field at an outer coil perimeter and a second print head configured for producing a maxel using the field near the aperture of the print head, where the first print head is vertical relative to the surface of the material being magnetized.

FIG. 10B depicts an exemplary dual-sided maxel printing system comprising a first print head configured to produce a maxel using the field at an outer coil perimeter and a second print head configured for producing a maxel using the field near the aperture of the print head, where the first print head is angled relative to the surface of the material being magnetized.

FIG. 10C depicts an exemplary dual-sided maxel printing system like that of FIG. 10A except the direction of the magnetic field of the second print head is reversed.

FIG. 10D depicts an exemplary dual-sided maxel printing system like that of FIG. 10B except the direction of the magnetic field of the second print head is reversed.

Although prior examples of magnetizable material 206 shown being magnetized in accordance with the invention had a rectangular cross-section, a rectangular cross-section is not required to practice the invention. Moreover, prior examples of print heads have shown print heads having rectangular cross-sections abutted against a material being magnetized. But, many other cross-sections are possible for print heads used in accordance with the invention such as described and depicted in U.S. non-provisional patent application Ser. Nos. 13/659,444 and 13/959,201, which were previously incorporated by reference. Additionally, print heads need not be abutted against a material in order to print a maxel in the material in accordance with the invention.

One skilled in the art will understand that a dual-sided maxel printing system can be configured to print maxels on magnetizable materials having different shapes and cross-sections, where the configuration of the two print heads and their characteristics, the characteristics of the material (e.g., coercivity, easy magnetization directions, etc), the print locations on the material, and the characteristics (e.g., field strengths) of the magnetic fields produced by the print heads determine the ultimate shape of the maxels printed in the material. Moreover, any type and grade of magnetizable material can be used including ferrite material, alnico material, neodymium iron boron material, samarium cobalt material, and any other material having appropriate coercivity properties, where magnetic fields produced by the two print heads can magnetize the material.

Figure 11A:
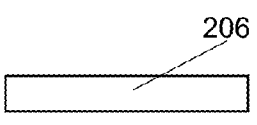
FIG. 11A depicts a cross-section of a magnetizable material having a rectangular shape.
Figure 11B:
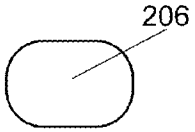
FIG. 11B depicts a cross-section of a magnetizable material having an oval shape.
Figure 11C:
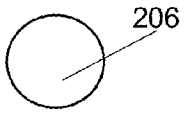
FIG. 11C depicts a cross-section of a magnetizable material having a round shape.
Figure 11D:
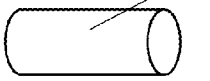
FIG. 11D depicts a magnetizable material having a cylindrical shape.
Figure 11E:
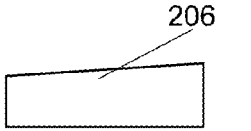
FIG. 11E depicts a cross-section of a magnetizable material having a varying thickness with four sides having straight edges.
Figure 11F:
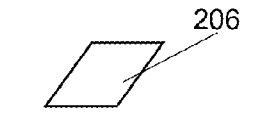
FIG. 11F depicts a cross-section of a magnetizable material having angles sides.
Figure 11G:
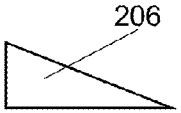
FIG. 11G depicts a cross-section of a magnetizable material having a triangular shape.
Figure 11H:
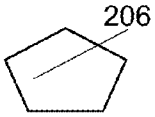
FIG. 11H depicts a cross-section of a magnetizable material having five sides.
Figure 11I:
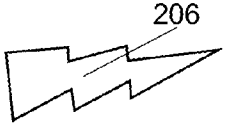
FIG. 11I depicts a cross-section of a magnetizable material having a jagged shape.
Figure 11J:
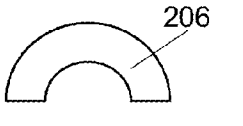
FIG. 11J depicts a cross-section of a magnetizable material having an arch shape.
Figure 11K:
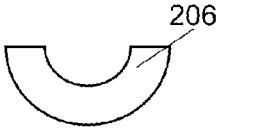
FIG. 11K depicts a cross-section of a magnetizable material having a bowl shape.
Figure 11L:
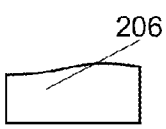
FIG. 11L depicts a cross-section of a magnetizable material having an varying thickness with three sides having straight edges and a fourth side having a curved edge.
Figure 11M:
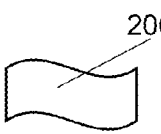
FIG. 11M depicts a cross-section of a magnetizable material having constant thickness having a top and a bottom having a curved surface and having sides having straight edges.
Figure 11N:
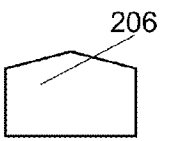
FIG. 11N depicts a cross-section of a magnetizable material having a shape resembling a building.
Figure 11O:
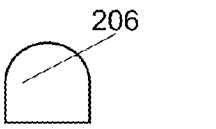
FIG. 11O depicts a cross-section of a magnetizable material having a shape resembling a mailbox.
Figure 11P:
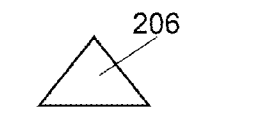
FIG. 11P depicts a cross-section of a magnetizable material having a shape resembling an isosceles triangle.
Figure 11Q:
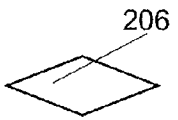
FIG. 11Q depicts a cross-section of a magnetizable material having a diamond shape.
Figure 11R:
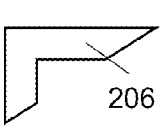
FIG. 11R depicts a cross-section of a magnetizable material resembling a triangle section removed from a triangle.

FIGS. 11A-11R provide different examples of cross-sections that a material 206 being magnetized may have in accordance with the invention, where many others are possible.

FIG. 11A depicts a cross-section of a magnetizable material 206 having a rectangular shape.

FIG. 11B depicts a cross-section of a magnetizable material 206 having an oval shape.

FIG. 11C depicts a cross-section of a magnetizable material 206 having a round shape.

FIG. 11D depicts a magnetizable material 206 having a cylindrical shape.

FIG. 11E depicts a cross-section of a magnetizable material 206 having a varying thickness with four sides having straight edges.

FIG. 11F depicts a cross-section of a magnetizable material 206 having angles sides.

FIG. 11G depicts a cross-section of a magnetizable material 206 having a triangular shape.

FIG. 11H depicts a cross-section of a magnetizable material 206 having five sides.

FIG. 11I depicts a cross-section of a magnetizable material 206 having a jagged shape.

FIG. 11J depicts a cross-section of a magnetizable material 206 having an arch shape.

FIG. 11K depicts a cross-section of a magnetizable material 206 having a bowl shape.

FIG. 11L depicts a cross-section of a magnetizable material 206 having an varying thickness with three sides having straight edges and a fourth side having a curved edge.

FIG. 11M depicts a cross-section of a magnetizable material 206 having constant thickness having a top and a bottom having a curved surface and having sides having straight edges.

FIG. 11N depicts a cross-section of a magnetizable material 206 having a shape resembling a building.

FIG. 11O depicts a cross-section of a magnetizable material 206 having a shape resembling a mailbox.

FIG. 11P depicts a cross-section of a magnetizable material 206 having a shape resembling an isosceles triangle.

FIG. 11Q depicts a cross-section of a magnetizable material 206 having a diamond shape.

FIG. 11R depicts a cross-section of a magnetizable material 206 resembling a triangle section removed from a triangle.

Figure 12A:
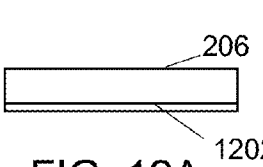
FIG. 12A depicts a magnetizable material having an active layer on one side.
Figure 12B:
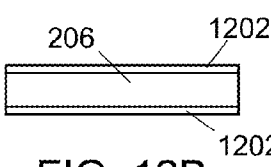
FIG. 12B depicts a magnetizable material having an active layer on opposing sides.

FIGS. 12A-12B depict various optional layers that can be used with materials 206 and/or with print heads 102 to achieve certain magnetic behaviors in accordance with the invention. The thicknesses of the layers depicted, which are shown being approximately the same, are not intended to be limiting but were used merely for clarity. In actuality, certain optional layers can be very thin relative to other layers where depicting such layers to scale would make them difficult to discern. In figures where several optional layers are shown between the print heads and the magnetizable material the distance between the print heads and the magnetizable is substantially exaggerated, where it should be understood that the various optional layers would actually be much thinner than depicted.

FIG. 12A depicts a magnetizable material 206 having an active layer 1202 on one side of the material 206, which can be used during printing to affect at least one of the magnetic fields produced by the print heads and therefore determine properties of maxels printed in the material such as the shape of the maxels, where an active layer is a magnetically active layer. A single active layer 1202 may also be used with a printed magnetic structure to direct flux from the side of the material 206 having the active layer 1202 to the opposite side of the material 206 and/or to otherwise provide shielding of flux that might otherwise affect a nearby object (e.g., a compass, credit card, etc.). The active layer 1202 can be configured such that when a second magnetic structure is brought into contact with printed magnetic structure, the active layer 1202 will provide magnetic circuits between aligning maxels of interfacing magnetic structures.

FIG. 12B depicts a magnetizable material 206 having a first active layer 1202*a* on a first side of the material 206 and a second active layer 1202*b* on a second side of the material 206 that is opposite the first side, which can be used during printing to affect the magnetic fields produced by the print heads and therefore determine properties of maxels printed in the material such as the shape of the maxels. The two active layers 1202*a* and 1202*b* may also be used with a printed magnetic structure to provide shielding of flux that might otherwise affect a nearby object (e.g., a compass, credit card, etc.) where the layers 1202*a* and 1202*b* can be configured such that they will provide magnetic circuits between aligning maxels of interfacing magnetic structures.

The print heads used in a dual-sided maxel printing system can have different configurations of various types of supplemental layers other than the flat conductive layers 202 of the print heads.

Figures 13, 14, 15, 16, 17:
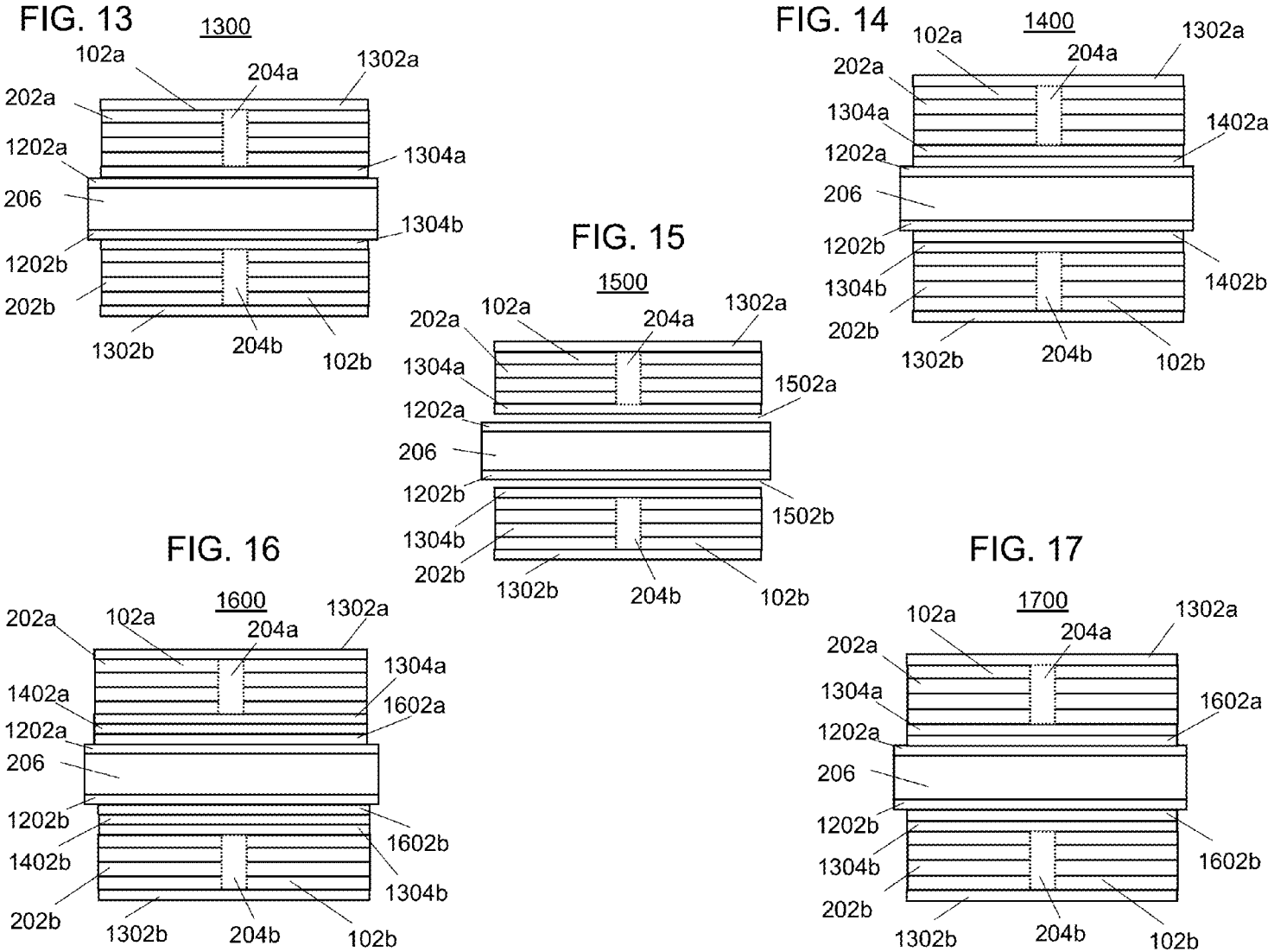
FIG. 13 depicts an exemplary dual-sided maxel printing system where each of the two print heads has magnetic shielding layers on both the top and bottom of the print heads.
FIG. 14 depicts an exemplary dual-sided maxel printing system like that of FIG. 13 with protective layers between the active layers associated with the magnetizable material and the magnetic shielding layers associated with the printing sides of the print heads.
FIG. 15 depicts an exemplary dual-sided maxel printing system like that of FIG. 13 with air gaps between the active layers associated with the magnetizable material and the magnetic shielding layers associated with the printing sides of the print heads.
FIG. 16 depicts an exemplary dual-sided maxel printing system like that of FIG. 14 with anti-friction layers between active layers associated with the magnetizable material and the magnetic shielding layers associated with the printing sides of the print heads.
FIG. 17 depicts an exemplary dual-sided maxel printing system like that of FIG. 13 with anti-friction layers between the active layers associated with the magnetizable material and the magnetic shielding layers on the printing sides of the print heads.

FIG. 13 depicts an exemplary dual-sided maxel printing system 1300 where each of two print heads 102*a* and 102*b* has magnetic shielding layers 1302*a* and 1302*b* on the non-printing side of the print heads and has magnetic shielding layers 1304*a* and 1304*b* on the printing side of the print heads, where a magnetic shielding layer is magnetically active and may be a solid piece of material or may have a hole corresponding to the hole of a corresponding print head and a slot extending from its hole to its perimeter. Moreover, a magnetic shielding layer can be made with laminate layers to avoid eddy currents. Such a magnetic shielding layer can also be used in lieu of a ceramic insulator/heat conductor/heat sink which can be used on the non-printing side of a print head. Various active an inactive approaches for cooling a print head are described in U.S. nonprovisional patent application Ser. No. 13/659,444, which has been previously incorporated by reference.

Referring to FIG. 13, the first print head 102*a* comprises four flat conductor layers 202*a* about a hole 204*a*. The first print head 102*a* has a magnetic shielding layer 1302*a* on its non-printing side and a magnetic shielding layer 1304*a* on its printing side that is adjacent to an active layer 1202*a* on a first side of a magnetizable material 206 that also has an active layer 1202*b* on a second side opposite its first side. The second print head 102*b* similarly comprises four flat conductor layers 202*b* about a hole 204*b*. The second print head 102*b* has a magnetic shielding layer 1302*b* on its non-printing side and a magnetic shielding layer 1304*b* on its printing side that is adjacent to the active layer 1202*b* on the second side of the magnetizable material 206. One or more magnetic shielding layers 1302 1304 can be optionally used on the printing side and/or non-printing side of one or more print heads 102 to affect the magnetic fields produced by the one or more print heads and therefore determine properties of maxels printed in the material such as the shape of the maxels. Because, magnetic shielding layers 1304 and active layers 1202 are both magnetically active, the magnetic shielding layers 1304*a* 1304*b* on the printing sides of the print heads may not be required to achieve similar maxel properties if active layers 1202*a* and 1202*b* are used with the material 206 such as depicted in FIG. 13. One skilled in the art will recognize that either an active layer 1202 associated with a material or a magnetic shielding layer 1304 associated with a print head could be used between a given print head 102 and the side of the material 206 to which it is adjacent since both layers are magnetically active.

FIG. 14 depicts an exemplary dual-sided maxel printing system 1400 like that of FIG. 13 except with protective layers 1402 between the active layers 1202 associated with the magnetizable material 206 and the magnetic shielding layers 1304 on the printing sides of the print heads 102. Referring to FIG. 14, a first protective layer 1402*a* is shown between a magnetic shielding layer 1304*a* on the printing side of a first print head 102*a* and an active layer 1202*a* that is on a first side of the magnetizable material 206. A second protective layer 1402*b* is also shown between a magnetic shielding layer 1304*b* on the printing side of a second print head 102*b* and an active layer 1202*b* that is on a second side of the magnetizable material 206 that is opposite the first side. The protective layer may be, for example, titanium, titanium nitride, stainless steel, chrome, aluminum, plastic, composite, or the like. A protective layer is typically not magnetically active so it will not affect the magnetic fields used to magnetize the magnetizable material. Instead, it is intended to protect a print head from being damaged.

FIG. 15 depicts an exemplary dual-sided maxel printing system 1500 like that of FIG. 13 with air gaps 1502 between the active layers 1202 associated with the magnetizable material 206 and the magnetic shielding layers 1304 on the printing sides of the print heads 102. Referring to FIG. 15, a first air gap 1502*a* is shown between a magnetic shielding layer 1304*a* on the printing side of a first print head 102*a* and an active layer 1202*a* that is on a first side of the magnetizable material 206. A second air gap 1502*b* is also shown between a magnetic shielding layer 1304*b* on the printing side of a second print head 102*b* and an active layer 1202*b* that is on a second side of the magnetizable material 206 that is opposite the first side. An air gap can also serve to protect a print head from being damaged by providing some operational clearance between the print head and the magnetizable material and any associated active layer 1202.

FIG. 16 depicts an exemplary dual-sided maxel printing system 1600 like that of FIG. 14 with anti-friction layers 1602 between the active layers 1202 associated with the magnetizable material 206 and the protective layers 1402 of the two print heads 102. Referring to FIG. 16, a first anti-friction layer 1602*a* is shown between a first protective layer 1402*a* of a first print head 102*a* and an active layer 1202*a* that is on a first side of the magnetizable material 206. A second anti-friction layer 1602*b* is also shown between a second protective layer 1402*b* of a second print head 102*b* and an active layer 1202*b* that is on a second side of the magnetizable material 206 that is opposite the first side. An anti-friction layer, for example a layer of Teflon or Kapton, can also be used to protect a print head from being damaged.

FIG. 17 depicts an exemplary dual-sided maxel printing system 1700 like that of FIG. 13 with anti-friction layers 1602 between the active layers 1202 associated with the magnetizable material 206 and the magnetic shielding layers 1304 on the printing sides of the print heads 102. Referring to FIG. 17, a first anti-friction layer 1602*a* is shown between a magnetic shielding layer 1304*a* on the printing side of a first print head 102*a* and an active layer 1202*a* that is on a first side of the magnetizable material 206. A second anti-friction layer 1602*b* is also shown between a magnetic shielding layer 1304*b* on the printing side of a second print head 102*b* and an active layer 1202*b* that is on a second side of the magnetizable material 206 that is opposite the first side. An air gap can also serve to protect a print head from being damaged by providing some operational clearance between the print head and the magnetizable material and any associated active layer 1202. An anti-friction layer, for example a layer of Teflon or Kapton, can also be used to protect a print head from being damaged.

U.S. nonprovisional U.S. Pat. No. 8,179,219 and U.S. nonprovisional patent application Ser. No. 13/659,444, which have been previously incorporated by reference, disclose various approaches for controlling and moving a magnetizable material relative to a print head, where either the material, the print head, or both are moved as controlled by a control system to position a hole of a print head adjacent to locations on a first side of the material at which maxels are printed. Various systems and methods for controlling and moving a magnetizable material relative to a print head are described including fixtures, trays, gantries, servo motors, tubes, barrels, handling robots, conveyor systems, turn tables, pick and place equipment, and the like, as well as the uses of springs and/or magnets to cause a print head to apply a force to the material. One skilled in the art will recognize that generally such systems and methods are applicable or adaptable for use with a dual-sided maxel printing system whereby the relative locations of two print heads moving relative to two sides of a material must be considered instead of the relative locations of only one print head moving relative to only one side of a material.

One approach for moving a magnetizable material relative to two print heads involves a transport mechanism that moves a tray having one or more pieces of magnetizable material into and out of a movement/printing volume, where the tray would be moved into and out of the movement/printing volume from one side of the movement/printing volume much like a card transport mechanism of an automated teller machine (ATM), gas pump, or vending machine. An alternative approach for moving a magnetizable material relative to two print heads involves a transport mechanism that moves a tray having one or more pieces of magnetizable material into and out of a movement/printing volume, where the tray would be moved into the movement/printing volume from a first side of the movement/printing volume and moved out of the movement/printing volume from a second side of the movement/printing volume. The alternative approach allows one tray after another to be fed into system. One skilled in the art would understand that various tray feeding mechanisms and tray removal mechanisms could be used as part of an automated continuous feed dual-sided maxel printing system, which could also include a tray transport mechanism (e.g., a conveyor) for moving trays from the printing system to a different manufacturing process.

A movement/printing volume may be a fixed volume due to the print heads being fixed (i.e., being unable to move) or the movement/printing volume may vary from a first volume during movement of the tray and second volume during printing. For example, the two print heads may be spaced apart by a first distance that provides clearances between the tray and the respective print heads whenever the tray and/or print heads are being moved. After movement of the tray and/or print heads but prior to printing, one or both of the two print heads can be moved closer to the tray, for example, by one or more solenoids, such that at the time of printing maxels the two print heads are spaced apart by a second distance that provides lessor clearances between the tray and the respective print heads to include zero clearances, where the print heads are in contact with the tray. After printing, the two print heads can be moved further away from the tray, for example, by the one or more solenoids. If such solenoids are used, the amount of current applied to a solenoid can be selected to achieve a desired force between the print head and the material.

FIGS. 18A-18E depict side, top, and bottom views of an exemplary dual-sided maxel printing system 1800 having capstans for moving a tray having magnetizable material into and out of a movement/printing volume. Referring to FIG. 18A-18E, the dual-sided maxel printing system 1800 includes two print heads 102*a* and 102*b* that are spaced apart such that there is a movement/printing volume 1810 between them. A tray 1802 has nine holes in which pieces of magnetizable material 206*a*-206*i* have been placed. Active layers 1806*a* and 1806*b* are located on top and bottom of the nine pieces of magnetizable material 206*a*-206*i*, respectively. The tray 1802 is made of a magnetically inactive material such as a hard plastic or rubber and may be rigid or flexible. Capstans 1808*a*-1808*f* are configured to move the tray 1802 into and out of the movement/printing volume 1810 between the two print heads 102*a* and 102*b*, where the tray 1802 can enter the movement/printing volume 1810 from one side and exit the movement/printing volume 1810 from the same side or, alternatively, the tray 1810 can enter the movement/printing volume 1810 from one side and can exit the movement/printing volume 1810 from the opposite side, as represented by the left-right and left arrows. The number and locations of the capstans 1808*a*-1808*f* are exemplary, where generally, the one or more capstans an be configured to move the tray back and forth or to only move the tray in one direction.

Figure 18A:
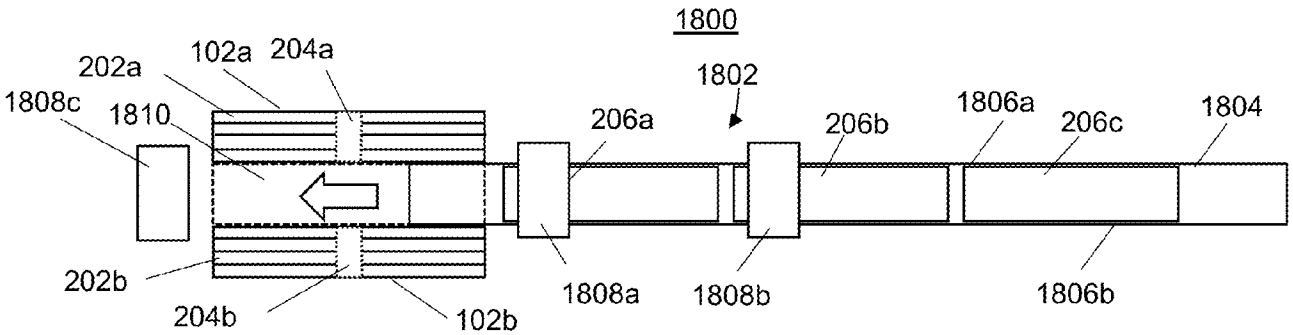
FIG. 18A-18E depict side, top, and bottom views of an exemplary dual-sided maxel printing system having capstans for moving a tray having magnetizable material into and out of a movement/printing volume.
Figure 18B:
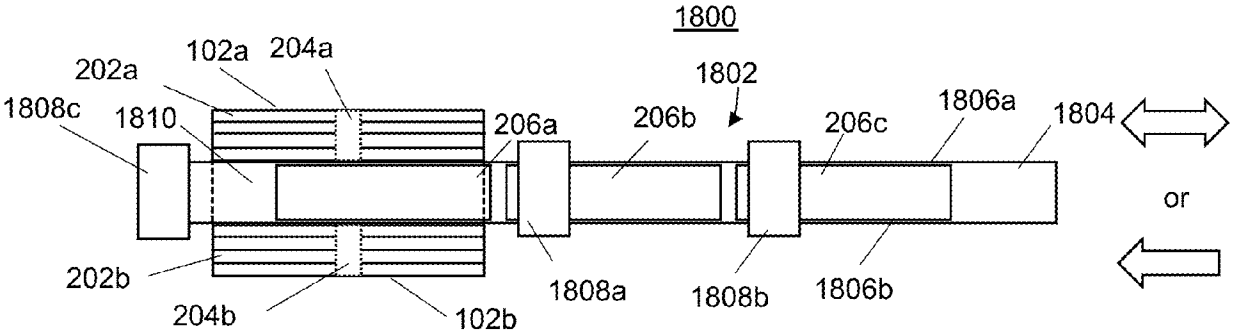
Figure 18C:
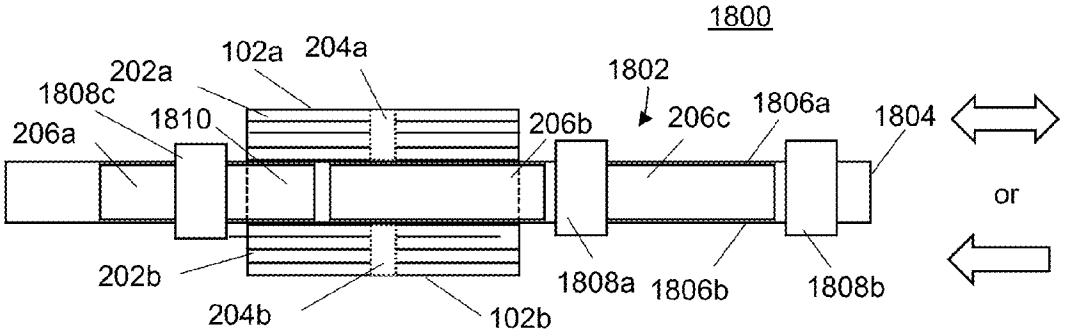
Figure 18D:
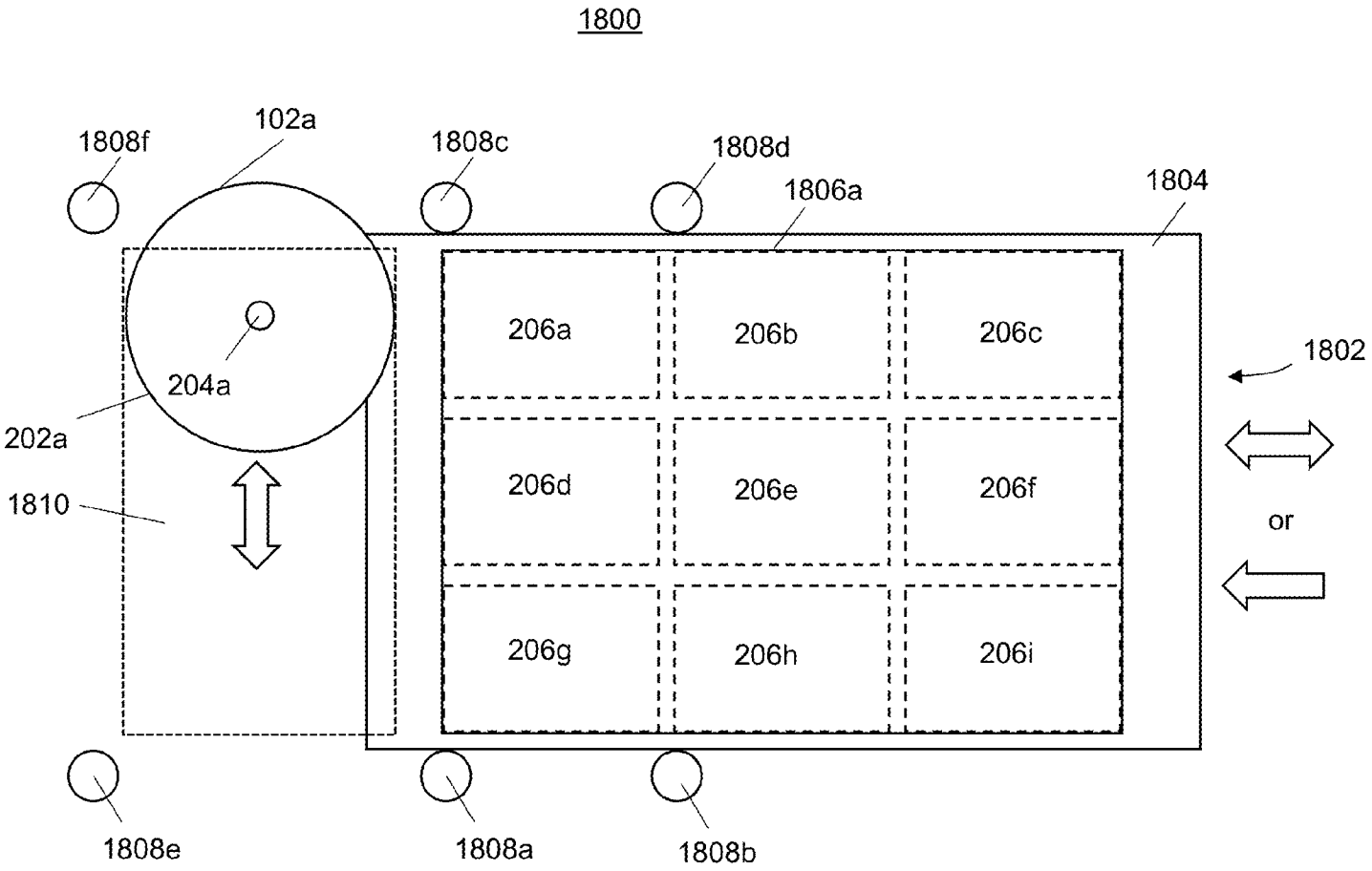
Figure 18E:
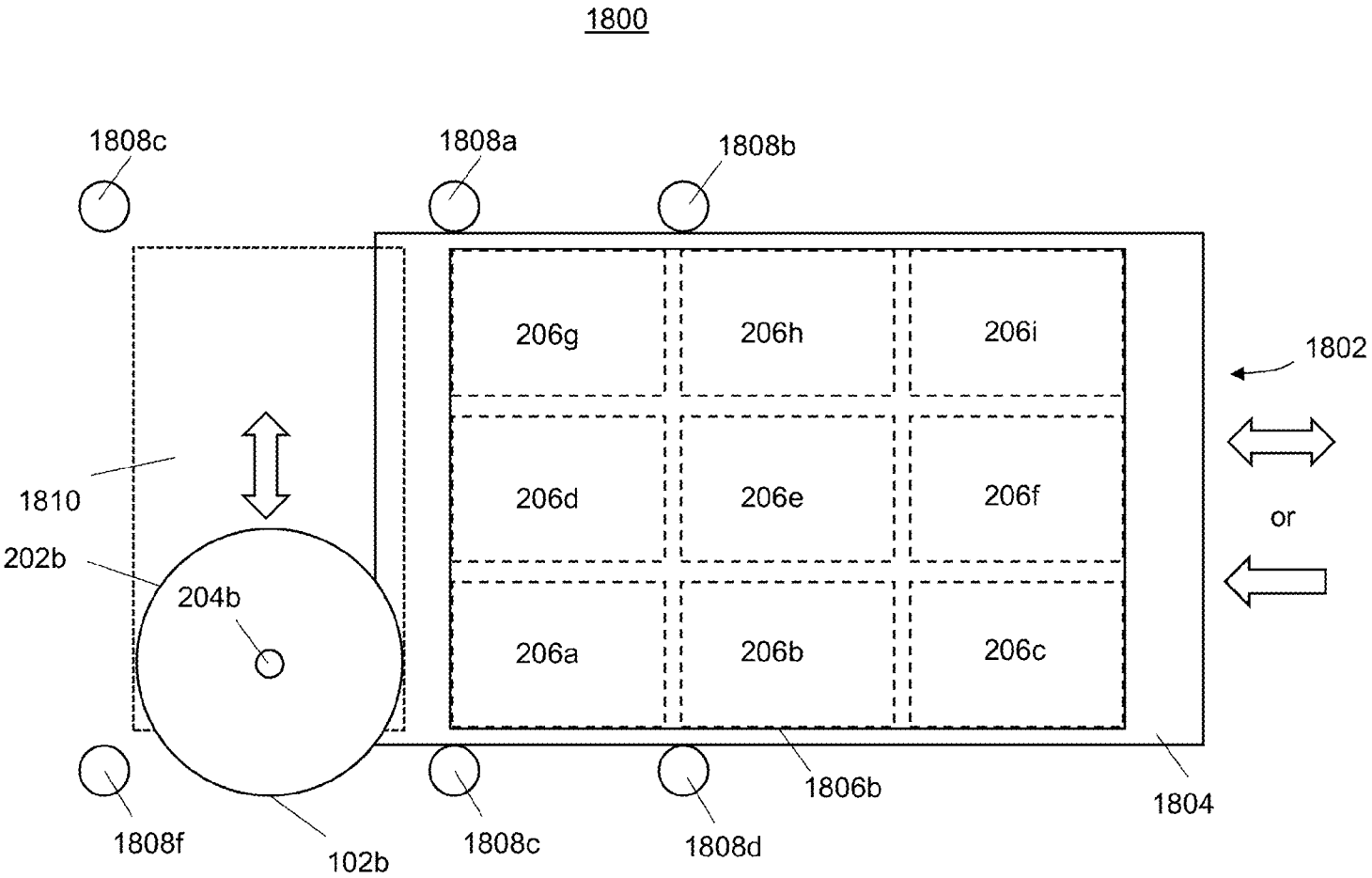

In FIG. 18A, the tray 1802 is shown entering the movement/printing volume 1810. In FIG. 18B, the tray 1802 is positioned such that print heads 102*a* and 102*b* can print maxels in the first piece of magnetizable material 206*a*. Similarly, in FIG. 18C, the tray 1802 is positioned such that print heads 102*a* and 102*b* can print maxels in the second piece of magnetizable material 206*b*. The first print head 102*a* having flat conductor layers 202*a* about a hole 204*a* is shown in FIG. 18D and the second print head 102*b* having flat conductor layers 202*b* a hole 204*b* is shown in FIG. 18E, where the tray 1802 is configured to be moved into the movement/printing volume 1810 between the two print heads 102*a* and 102*b* and the two print heads 102*a* and 102*b* are configured to move perpendicular to the direction of movement of the tray 1802.

In accordance with another aspect of a preferred embodiment of the invention, maxels can be printed in a non-stop mode while the print head and/or material are being moved to the various locations at which maxels are to be printed. The single-sided maxel printing processes that have been previously described have typically involved positioning a hole of a print head adjacent to a print location on a material where a maxel is to be printed after which movement is stopped while a maxel is printed. With the non-stop mode, the movement of the two print heads and/or material continues while maxels are being printed, whereby SCRs are triggered as the respective holes of the print heads pass by locations at which maxels are to be printed.

Figure 19:
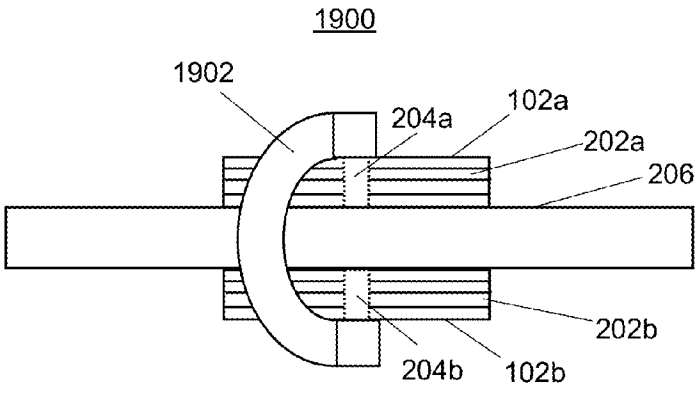
FIG. 19 depicts an exemplary dual-sided maxel printing system that includes a magnetically active material that extends between the openings of the apertures on the non-printing sides of the two print heads.

In accordance with another aspect of the invention shown in FIG. 19, an exemplary dual-sided maxel printing system 1900 includes a magnetically active material 1902 that extends between the openings of the apertures 204*a* and 204*b* on the non-printing sides of the two print heads 102*a* and 102*b* so as to provide a flux path (or circuit) that has a much lower reluctance than air.

Figure 20:
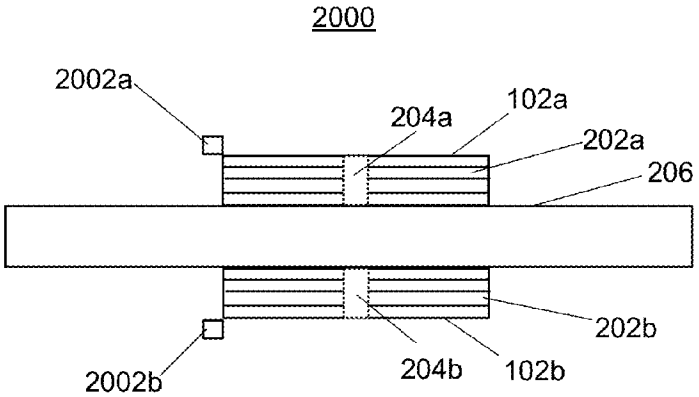
FIG. 20 depicts an exemplary dual-sided maxel printing system that includes displacement sensors used to measure the distances between the printing sides of the print heads and their corresponding surfaces of a magnetizable material.

In accordance with another aspect of the invention shown in FIG. 20, an exemplary dual-sided maxel printing system 2000 includes displacement sensors 2002*a* and 2002*b* used to measure the distances between the printing sides of the print heads 102*a* and 102*b* and their corresponding surfaces of a magnetizable material. A displacement sensor 2002*a* and 2002*b* may be laser sensor, LED sensor, ultrasonic sensor, eddy current sensor, or the like. A given measured distance can be used to determine or enforce clearances between the material and print heads so as to prevent a collision that could damage a print head or the material.

Figure 21:
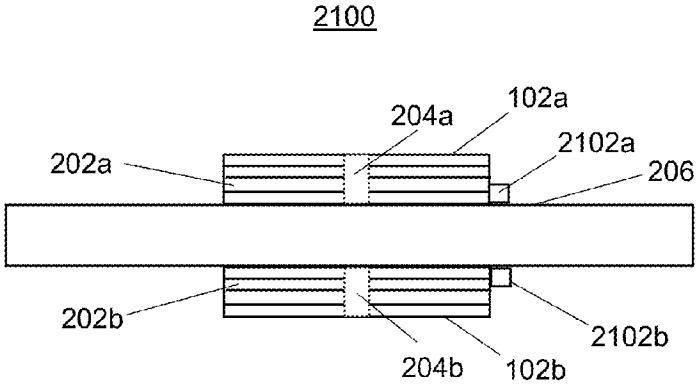
FIG. 21 depicts an exemplary dual-sided maxel printing system that includes magnetic field measurement sensors.

In accordance with another aspect of the invention shown in FIG. 21, an exemplary dual-sided maxel printing system 2100 includes magnetic field measurement sensors 2102*a* and 2102*b*, which can be used to measure magnetic fields during printing and which can be used to produce magnetic field scans after all the various maxels of a magnetic structure have been printed.

Figure 22:
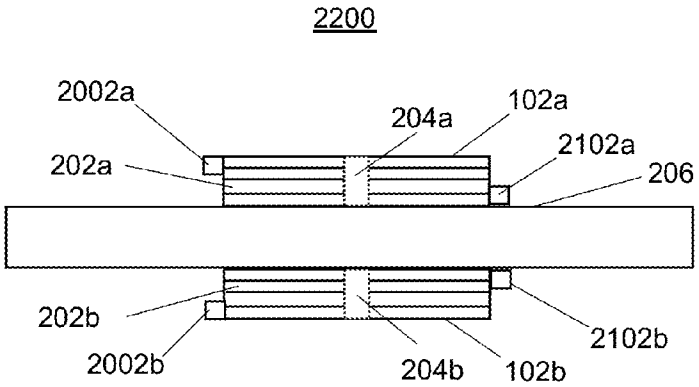
FIG. 22 depicts an exemplary dual-sided maxel printing system that includes displacement sensors and magnetic field measurement sensors.

In accordance with another aspect of the invention shown in FIG. 22, an exemplary dual-sided maxel printing system 2200 includes displacement sensors 2002*a* and 2002*b* and magnetic field measurement sensors 2102*a* and 2102*b*.

One skilled in the art will understand that a critical damping resistor, or collapsing flux resistor, can be used in a magnetizing circuit to prevent current oscillation through the print head, where the critical damping resistor has a low characteristic inductance and is able to withstand high average power and high peak power simultaneously. A critical damping resistor must have sufficient conductance to provide electrical resistance yet insufficient conductance to cause substantial current reversal and thereby prevent current oscillation through the print head. In particular, one skilled in the art will understand that a critical damping resistor in series with a back diode functions as a critical damping (or snubber) circuit for damping inductive current. One skilled in the art will recognize that a snubber circuit may be used across a print head, across a current controlling device, or any combination thereof. Similarly, a critical damping resistor can be used without a back diode across a print head, across a current controlling device, or any combination thereof. Moreover, if multiple print heads are placed in series, a snubber circuit or a critical damping resistor can be used across the series of print heads, across a current controlling device, or any combination thereof.

While particular embodiments of the invention have been described, it will be understood, however, that the invention is not limited thereto, since modifications may be made by those skilled in the art, particularly in light of the foregoing teachings.

The invention claimed is:

1. A system for magnetizing magnetic sources into a rare earth permanent magnet material; comprising:

a first inductor coil comprising a first plurality of layers of a flat conductor about a first aperture positioned on a first side of said rare earth permanent magnet material at a first location where a magnetic source is to be magnetized into said rare earth permanent magnet material from said first side of said rare earth permanent magnet material;

a second inductor coil comprising a second plurality of layers of a flat conductor coiled about a second aperture positioned on a second side of said rare earth permanent magnet material at a second location where a magnetic source is to be magnetized into said rare earth permanent magnet material from said second side of said rare earth permanent magnet material, said second side being opposite said first side; and at least one magnetizing circuit for supplying a first current having a first direction for a first duration to said first inductor coil to produce a first magnetic field and a second current having a second direction for a second duration to said second inductor coil to produce a second magnetic field, wherein the first and second inductor coils concentrates a flux in a desired direction and disperse a return flux that does not magnetize the rare earth permanent magnet material in an area with an opposite magnetic polarity.

2. The system of claim 1, wherein the first inductor coil and the second inductor coil are configured to produce magnetic fields having substantially the same field strengths when substantially the same amount of current is supplied to each of the two print heads.

3. The system of claim 1, wherein said first inductor coil and said second inductor coil are connected in series to a magnetizing circuit via a supply line.

4. The system of claim 1, wherein the first aperture and the second aperture are substantially aligned with each other.

5. The system of claim 1, wherein said first inductor coil and said second inductor coil are driven by independent magnetizing circuits via separate supply lines.

6. The system of claim 5, wherein said first inductor coil and said second inductor coil are configured to have substantially matched impedance.

7. The system of claim 5, wherein the first inductor coil and the second inductor coil are supplied substantially the same amounts of current having the same directions for the same durations.

8. The system of claim 5, wherein the first inductor coil and the second inductor coil are supplied at least one of a different amount of current, currents for different durations, or currents having different directions.

9. The system of claim 1, wherein the coil diameter of the first inductor coil is substantially the same as the coil diameter of the second inductor coil.

10. The system of claim 1, wherein the diameter of the first aperture is substantially the same as the diameter of the second aperture.

11. The system of claim 1, wherein the first inductor coil and the second inductor coil have substantially the same aperture diameter-to-coil diameter ratio.

12. The system of claim 1, wherein the conductor layers of the first inductor coil have substantially the same thickness as the conductor layers of the second inductor coil.

13. The system of claim 1, wherein the first inductor coil and the second inductor coil have substantially the same number of coil layers.

14. The system of claim 1, wherein the first inductor coil and second inductor coil have vertical apertures.

15. The system of claim 1, wherein at least one of the first inductor coil or the second inductor coil has one of an angled aperture or a conical aperture.

16. The system of claim 1, wherein the first magnetic field and the second magnetic field at least partially cancel.

17. The system of claim 1, wherein the first magnetic field and the second magnetic field produce a magnetic source that extends from said first side of said rare earth permanent magnet material to said second side of said rare earth permanent magnet material.

18. The system of claim 17, wherein said magnetic source has a substantially cylindrical volume in said rare earth permanent magnet material.

19. A method for magnetizing magnetic sources into a rare earth permanent magnet material; comprising:

providing a first inductor coil comprising a first plurality of layers of a flat conductor about a first aperture;

positioning said first aperture on a first side of said rare earth permanent magnet material at a first location where a magnetic source is to be magnetized into said rare earth permanent magnet material from said first side of said rare earth permanent magnet material;

providing a second inductor coil comprising a second plurality of layers of a flat conductor coiled about a second aperture;

positioning said second aperture on a second side of said rare earth permanent magnet material at a second location where a magnetic source is to be magnetized into said rare earth permanent magnet material from said second side of said rare earth permanent magnet material, said second side being opposite said first side; and supplying using at least one magnetizing circuit a first current having a first direction for a first duration to said first inductor coil to produce a first magnetic field and a second current having a second direction for a second duration to said second inductor coil to produce a second magnetic field, wherein the first and second inductor coils concentrates a flux in a desired direction and disperse a return flux that does not magnetize the rare earth permanent magnet material in an area with an opposite magnetic polarity.

20. The method of claim 19, wherein the first magnetic field and the second magnetic field produce a magnetic source that extends from said first side of said rare earth permanent magnet material to said second side of said rare earth permanent magnet material.

* * * * *